US009586082B2

(12) United States Patent
Cranke et al.

(10) Patent No.: US 9,586,082 B2
(45) **Date of Patent: *Mar. 7, 2017**

(54) SPORTS PERFORMANCE ENHANCEMENT SYSTEMS

(71) Applicant: Functionwear, LLC, Boulder, CO (US)

(72) Inventors: Christopher T. Cranke, Upper Marlboro, MD (US); Daniel Schreiber, Bethesda, MD (US)

(73) Assignee: FUNCTIONWEAR, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/533,190

(22) Filed: Nov. 5, 2014

(65) Prior Publication Data

US 2015/0057135 A1 Feb. 26, 2015

Related U.S. Application Data

(63) Continuation of application No. 13/887,925, filed on May 6, 2013, now Pat. No. 8,915,827, which is a (Continued)

(51) Int. Cl.
*A63B 21/00* (2006.01)
*A63B 21/02* (2006.01)
(Continued)

(52) U.S. Cl.
CPC ..... *A63B 21/16* (2013.01); *A43B 5/00* (2013.01); *A63B 21/0442* (2013.01);
(Continued)

(58) Field of Classification Search
CPC ..... A63B 21/0552
See application file for complete search history.

(56) References Cited

U.S. PATENT DOCUMENTS 843,478 A * 2/1907 Muller ..... A63B 21/0552 482/124
1,269,518 A 6/1918 Bain
(Continued)

FOREIGN PATENT DOCUMENTS

| | | |
|---|---|---|
| CA | 2393413 A | 2/2004 |
| GB | 245274 | 1/1925 |
| KR | 101011469 B1 | 1/2011 |

*Primary Examiner* — Loan H Thanh
*Assistant Examiner* — Rae Fischer
(74) *Attorney, Agent, or Firm* — Maginot, Moore & Beck LLP

(57) ABSTRACT

Footwear for use in resistance band training includes plural spaced straps extending loosely over the instep. Each strap is circumscribed by a connection ring freely movable along the strap such that, when the ring is pulled by an applied force, the ring traverses the strap and is repositioned according to the direction of the force. The user may alternatively select any of the straps to engage a resistance band. A belt for connection to the straps includes a band connection ring movable to different positions on the belt. A pad may be positioned over a front belt ring to comfortably project the band away from the user's body. The footwear and belt may be used with a vest connected to limbs and extremities to body parts for a full body workout.

20 Claims, 33 Drawing Sheets

Related U.S. Application Data continuation-in-part of application No. 13/464,853, filed on May 4, 2012, now Pat. No. 8,968,166.

(60) Provisional application No. 61/778,726, filed on Mar. 13, 2013.

(51) Int. Cl.

| | |
|---|---|
| ***A63B 21/16*** | (2006.01) |
| ***A63B 21/055*** | (2006.01) |
| ***A43B 5/00*** | (2006.01) |
| ***A63B 21/04*** | (2006.01) |
| ***A63B 23/035*** | (2006.01) |

(52) U.S. Cl.

CPC ..... *A63B 21/0552* (2013.01); *A63B 21/0557* (2013.01); *A63B 21/4007* (2015.10); *A63B 21/4015* (2015.10); *A63B 21/4019* (2015.10); *A63B 21/4025* (2015.10); *A63B 21/4043* (2015.10); *A63B 23/03541* (2013.01); *A63B 23/03575* (2013.01)

(56) References Cited

U.S. PATENT DOCUMENTS

| | | | | | |
|---|---|---|---|---|---|
| 1,562,294 | A | * | 11/1925 | Cooper | A61F 5/0104 2/239 |
| 1,618,273 | A | * | 2/1927 | Davidson | A63B 21/0004 482/124 |
| 2,097,376 | A | * | 10/1937 | Marshman | A63B 21/0004 182/6 |
| 3,162,441 | A | | 12/1964 | Karlik | |
| 3,999,752 | A | | 12/1976 | Kupperman et al. | |
| 4,273,328 | A | | 6/1981 | Ozbey et al. | |
| 4,596,387 | A | | 6/1986 | Roberts | |
| 4,728,103 | A | | 3/1988 | Fulton | |
| 4,815,729 | A | | 3/1989 | Stefanski | |
| 4,815,731 | A | | 3/1989 | Suarez et al. | |
| 4,993,705 | A | | 2/1991 | Tolle | |
| 5,186,701 | A | | 2/1993 | Wilkinson | |
| 5,203,754 | A | | 4/1993 | Maclean | |
| 5,263,916 | A | | 11/1993 | Bobich | |
| 5,433,688 | A | | 7/1995 | Davies | |
| 5,490,826 | A | | 2/1996 | Rose | |
| 5,518,480 | A | | 5/1996 | Frappier | |
| 5,545,113 | A | | 8/1996 | Bobich | |
| 5,653,668 | A | | 8/1997 | Wilkinson | |
| 5,683,336 | A | | 11/1997 | Pape | |
| 5,716,307 | A | | 2/1998 | Vadher | |
| 5,720,042 | A | | 2/1998 | Wilkinson | |
| 5,727,254 | A | | 3/1998 | Dicker | |
| 5,782,727 | A | | 7/1998 | Pierce | |
| 5,792,034 | A | | 8/1998 | Kozlovsky | |
| 5,800,319 | A | | 9/1998 | Choate | |
| 5,820,534 | A | | 10/1998 | Vadher | |
| 5,867,826 | A | | 2/1999 | Wilkinson | |
| 5,993,362 | A | | 11/1999 | Ghobadi | |
| 6,099,446 | A | | 8/2000 | Johnson et al. | |
| 6,361,516 | B1 | | 3/2002 | Hamel | |
| 6,551,221 | B1 | | 4/2003 | Marco | |
| 6,962,555 | B2 | | 11/2005 | Behman | |
| 7,004,892 | B2 | | 2/2006 | Marco | |
| 7,087,003 | B1 | | 8/2006 | Katterjohn | |
| 7,261,679 | B2 | | 8/2007 | Sload | |
| 7,608,026 | B1 | | 10/2009 | Nicassio | |
| 7,618,356 | B1 | | 11/2009 | Johnson et al. | |
| 7,628,742 | B2 | | 12/2009 | Weaver | |
| 7,744,511 | B2 | | 6/2010 | Grigoriev et al. | |
| 7,794,368 | B2 | | 9/2010 | Rutherford | |
| 7,850,583 | B2 | | 12/2010 | Smith | |
| 8,142,336 | B1 | | 3/2012 | Yates | |
| 8,337,371 | B2 | | 12/2012 | Vollmer, Jr. | |
| 2002/0066208 | A1 | | 6/2002 | Hall | |
| 2002/0068667 | A1 | | 6/2002 | Strachan | |
| 2004/0204302 | A1 | | 10/2004 | Flynn | |
| 2005/0043150 | A1 | | 2/2005 | Nitta et al. | |
| 2005/0261113 | A1 | | 11/2005 | Wilkinson | |
| 2006/0040805 | A1 | | 2/2006 | Wilkinson | |
| 2006/0183609 | A1 | | 8/2006 | Flynn | |
| 2007/0060454 | A1 | | 3/2007 | Vogel | |
| 2008/0287840 | A1 | | 11/2008 | Koscielny | |
| 2009/0217550 | A1 | | 9/2009 | Koo | |
| 2011/0209264 | A1 | | 9/2011 | Williams et al. | |
| 2013/0045842 | A1 | | 2/2013 | Wood | |
| 2013/0067767 | A1 | | 3/2013 | Casto | |

* cited by examiner

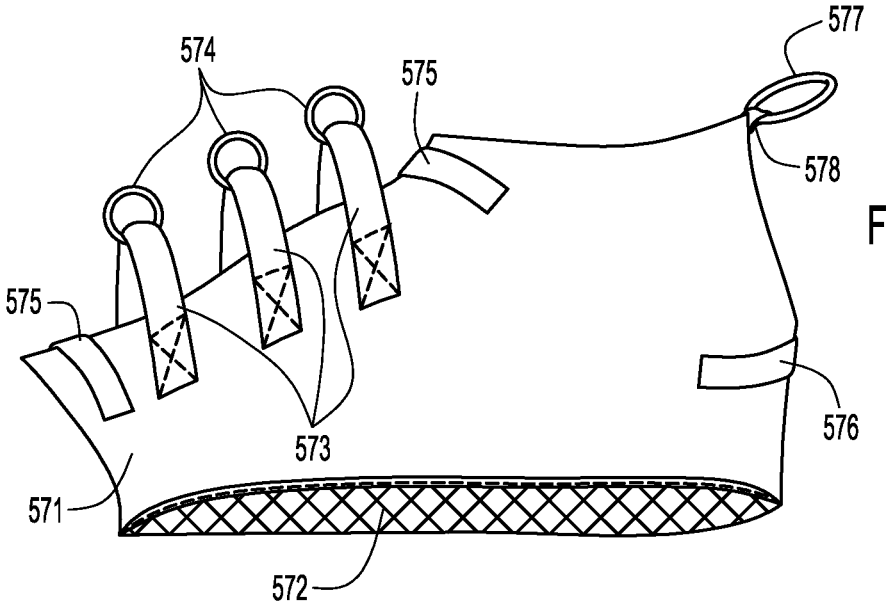
FIG.28
FIG.29
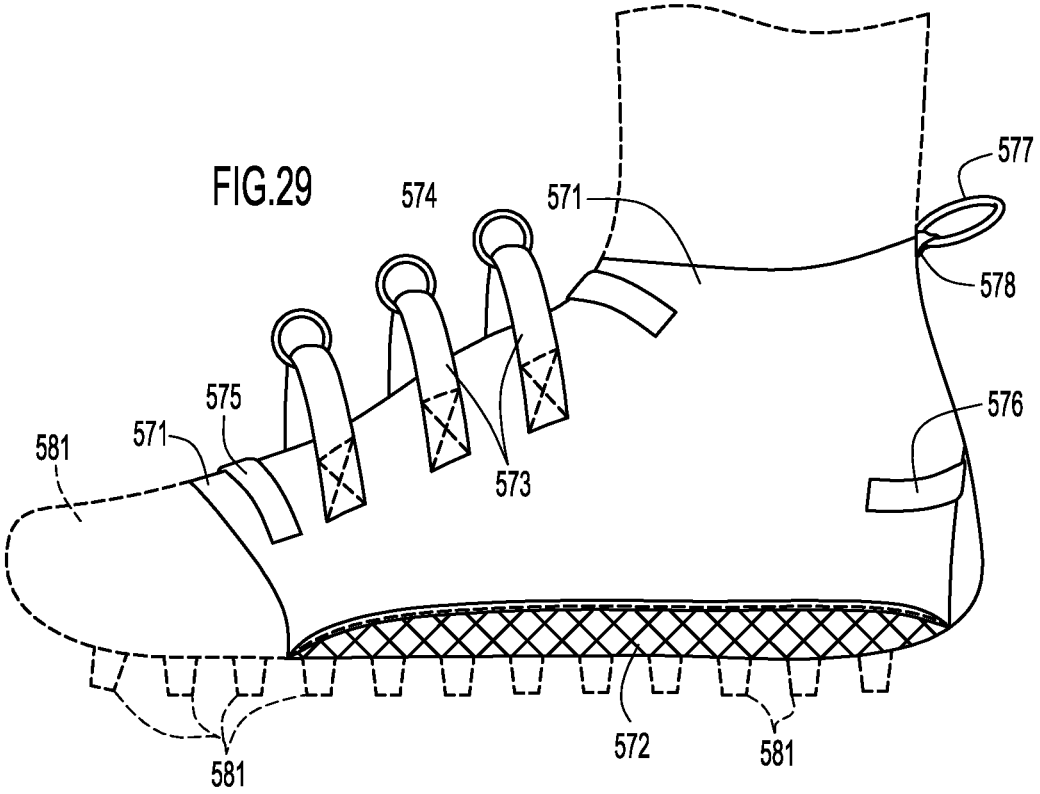

SPORTS PERFORMANCE ENHANCEMENT SYSTEMS

CROSS REFERENCE TO RELATED APPLICATION

This application is a continuation of, and claims priority from, U.S. patent application ser. No. 13/887,925, filed May. 06, 2013, and entitled "Sports Performance Enhancement Systems" (published as U.S. Patent Application Pub. No. US 2013/0333097), which is a continuation-in-part of U.S. patent application serial No. 13/464,853, filed May 4, 2012 and entitled "Sports Performance Enhancement System" (published as U.S. Patent Application Pub. No. US 2012/0283077), and also claims priority from U.S. Provisional Patent Application Ser. No. 61/778726, filed Mar. 13, 2013 and entitled "Improvements in Sports Performance Enhancement Systems". The entire disclosures in those applications are incorporated herein by reference.

BACKGROUND

Field of the Invention

The present invention relates generally to exercise equipment and, more particularly, to a total body sports performance enhancement system that allows the user to build strength at a faster rate through resistance training while keeping his/her hands free. The invention further pertains to improved footwear and belt configurations for use in such systems.

State of the Art

Sports performance enhancement systems can improve accuracy, endurance, precision, strength and efficiency, as well as several other key athletic and fitness attributes. Being an athlete and/or staying in shape requires considerable time and effort. Athletes must train their entire bodies in order to achieve total body fitness, which is a prerequisite in order to excel as a top tier athlete and to obtain an optimal body condition. The rewards of such an achievement are immense, yet the journey towards these pinnacles requires a great deal of time consuming dedication and exertion. The problem is that, normally, the aspiring athlete and/or fitness enthusiast would have to work out a vast array of different body parts, such as the upper and lower body, limbs hands, feet, etc. Then, he or she must maintain his/her cardio fitness by running and or jogging. Then, in the case of the athletes, they must practice movements in their particular sports to improve and sharpen the skill sets required for those sports. Therefore, there is a need for a versatile total body exercise system that can save time yet not compromise on the rigorous training that serious competitors and fitness enthusiasts need to reach their goals while effectively activating multiple muscles simultaneously.

Most devices and systems that attempt to create a total body workout system fall short because they either do not cover the entire spectrum of an effective complete body workout, or are ineffective due to poor design, or are either unsafe or uncomfortable to use. In other words, there is no safe and effective full body workout system that encompasses the foundation of free weight resistance. The two free weight exercises that represent the most strength or power are bench presses and leg presses (or leg squats). Each represents or addresses upper and lower body strength. Other exercises that represent the next best strength enhancement in free weights are arm and leg curls, as well as arm and leg extensions. This is the cornerstone of free weight exercise. For years these strength enhancements have provided adequate strength and performance enhancement exercise for millions of people. However, the problem remains that these strength enhancement exercises are very time consuming, and most devices that attempt to provide the full body workout are usually stationary exercises machines.

The exercises mentioned above provide good workouts because the focus of resistance force is underneath the finger tips and inside the palm of the hand (in the case of upper-body workouts), or near the ankles (in the case of lower-body workouts). These upper and lower body exercise actions are revolutionary because they incorporate two parts of the human body that make humans unique compared to any other species. The first part is the soles of the feet, which allow humans to walk upright. The second part is the fingers and palms of the hands that allow humans to build and create objects with their hands. The best way to improve the human body from the athlete's standpoint is to stay true to these focus areas while exercising. It is also to be noted and reiterated that the inside of the hand and the bottom of the feet, particularly the balls of the feet, are the main points of focus for resistance force. Most athletes are limited to performing one workout regimen in intervals, thus consuming a lot of time and also incorporating multiple body parts, but losing the core points of focus in doing so. Since each workout is individually performed, each workout requires a specific amount of time. To become a great athlete is one of the most challenging tasks to accomplish. Top athletes perform many full body workouts for many years at an aggressive level.

Resistance band training is an excellent alternative exercise tool that is not as stationary as other techniques and provides an effective workout with more creative capabilities. Early prior art resistance band workout equipment, whether it includes a bow or has twisting functions, or is adapted to hang from a door, share a common oversight. These products require use of the hands of the athlete, resulting in restricted use of the equipment. That is, these products are intended to provide resistance by use of some sort of handle, but these products have limited usage for aspiring athletes due to the confined parameters in which they were designed.

Different athletes require different skill sets. For example, in the game of basketball, certain players may have a better low post game while others have better shooting abilities. Often, the athlete with the better low post game may want to improve his or her shooting skills; however, most of the commercially available products are too general and not specific enough to improve shooting skills. Most of these products occupy the hands of the athlete during the exercise process, and since the hands are needed for practicing many skills, there is a disconnect between the exercising process and the skill practice.

More recently there have been attempts to provide resistance band exercise systems that free the user's hands. Examples can be found in the following patent documents: U.S. Pat. No. 5,186,701 (Wilkinson), U.S. Pat. No. 5,720,042 (Wilkinson), U.S. Pat. No. 5,993,362 (Ghobadi) and U.S. Pat. No. 6,099,446 (Johnson et al). The entire disclosures in these patents are incorporated herein by reference for purposes of background information. The systems disclosed in these patents have various disadvantages, but the most noticeable, and the one common to all, is the failure to recognize the importance of the foot as opposed to the ankle. More specifically, prior art systems ignore the importance of both plantar flexion and dorsiflexion training. Plantar flexion is the movement which increases the angle between the front part of the foot and the shin; that is, it applies to the movement of the foot about the ankle joint such that the toes are moved away from the shin. Dorsiflexion is the opposite movement; it is the movement which decreases the angle between the dorsum (i.e., the superior surface) of the foot and the leg, so that the toes are brought closer to the shin. Plantar flexion and dorsiflexion are critical to running, jumping and similar athletic activities; yet the stretching and strengthening of these muscles is largely ignored in these prior systems. A major reason for these failings is the improper directivity and application location of the tension forces applied through the resistance bands to the user's foot. If not applied evenly or uniformly, such forces can be ineffective and, more importantly, can cause injury such as sprained or broken ankles.

Also ignored in prior systems is the need for providing the user with the capability of selectively adapting the system so as to exercise the foot and leg muscles in different manners for training in different sports and athletic performances.

It is desirable, therefore, to provide a resistance band training and exercise system which, in use, frees the user's hands to engage in skill training and permits a user to freely move about and perform a variety of exercise and training activities. It is further desirable to provide such a system which permits the user to selectively adapt the system to safely and efficiently exercise the muscles that control movement of the user's foot and leg. It would also be desirable to provide components of such a system which assure that the tension forces are applied by the resistance bands to the optimum locations of the user's body parts such as the feet, and in the proper directions, to assure safe and effective exercising routines.

SUMMARY

The present invention allows an athlete to combine the exercising process and the skill practice for any given sport or activity; that is, the present invention allows athletes to exercise with traditional resistance bands while keeping their hands free to practice the specific sport skills. One aspect of the present invention is keeping the focus of resistance force uniformly underneath the finger tips, in the center of the hand just as a handle would, and uniformly underneath the foot, the sole of the foot. In so doing the invention allows perfect balance to the athlete's exercise. In addition, the present invention is designed such that the proximal ends of resistance bands are positionally stabilized on the user's body, as opposed to an external support or structure, thereby permitting the user to move about freely and engage in a wide variety of exercise regimens.

In accordance with the present invention a resistant band mechanism provides the same benefits as traditional resistant bands but allows freedom to the athlete's hands so that the athlete can add the present invention to his/her existing practice routine. Although the invention as originally conceived was intended to improve and develop skills such as shooting for use in playing basketball, the invention can be used for developing and improving skills a vast array of sports. For example, the invention can be used for football to improve the skills of a receiver attempting to catch a football, or the skills of a passer attempting to throw a football, or the skills of linemen in moving and maneuvering an opponent. Likewise, a tennis player can use the invention to practice serving, forehand strokes and backhand strokes; a soccer player can use the invention to practice dribbling and shooting; etc., the list is unlimited. Thus, the invention allows athletes to practice a wide range of movements and efforts specific to their sports while they exercise against the force of resistance bands. The present invention contrasts with many traditional resistance band technology because the present invention applies resistance band tension forces evenly to the user's body, particularly to the foot. Specifically, the forces are directed to either the sole or both sides of the foot, thereby assuring optimally effective and safe force application. Additionally, the present invention not only saves time but concurrently activates multiple full body muscle groups without compromising the key points of resistance force in the defined special areas.

There are usually two to three key areas, such as weight resistance, cardio, and practice in a particular sport, that athletes and fitness enthusiasts must work out to excel in their respected discipline. Therefore, it is an object of the present invention to provide the user with benefits of all three areas to maximize each workout while minimizing time. For weight resistance the present invention uses resistance bands in specialized areas, previously not available with most prior products and systems. For cardio exercise the present invention uses constant resistance as a method to cover the area for cardio. For practice in a particular sport, the present invention can be worn during the entire practice session. The present invention incorporates all three areas simultaneously, thus not only saving time, but maximizing the effectiveness of time spent training to the fullest potential.

In another important aspect of the invention, improved footwear, either an improved training shoe structure, a foot bed insert for a conventional shoe, a modified ankle brace, or a modified sock, is provided for use in a resistance band exercise system of the type described. The shoe, for example, includes at least a first strap extending over the forward portion of a shoe upper between two first strap attachment locations at the junction of the shoe upper and outsole on opposite sides of the shoe upper. The strap is provided with slack so as to be loosely spaced above shoe upper. A first connection ring is circumscribes and is freely movable along the strap, and the ring and strap are configured and constructed to be connected via the ring to a resistance band such that, when the ring is pulled by an applied force, the ring is free to both traverse the strap and pull it in the direction of the force. The slack is sufficient to permit the ring to be pulled transversely outwardly of the shoe periphery.

In another aspect of the invention the strap may be a continuous loop extending between the insole and outsole of the shoe. In addition, the strap is secured by stitching to the shoe upper immediately adjacent the junction between the shoe upper and outsole. A rear connection ring can be secured at a proximal end or heel of the shoe and configured to be connected to another elastic resistance band. Preferably, plural spaced straps, each with a movable connection ring, are provided in spaced relation so that a resistance band can be alternatively connected to any of the connection rings to provide selective plantar flexion and/or dorsiflexion exercise and to accommodate user comfort.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

BRIEF DESCRIPTION OF THE DRAWINGS

FIG. 28 is a side view of a sock adapted to be worn over a cleated shoe in accordance with the present invention.

FIG. 29 is side view of the sock of FIG. 28 as worn over a cleated shoe.

DESCRIPTION OF THE EMBODIMENTS

Figure 1:
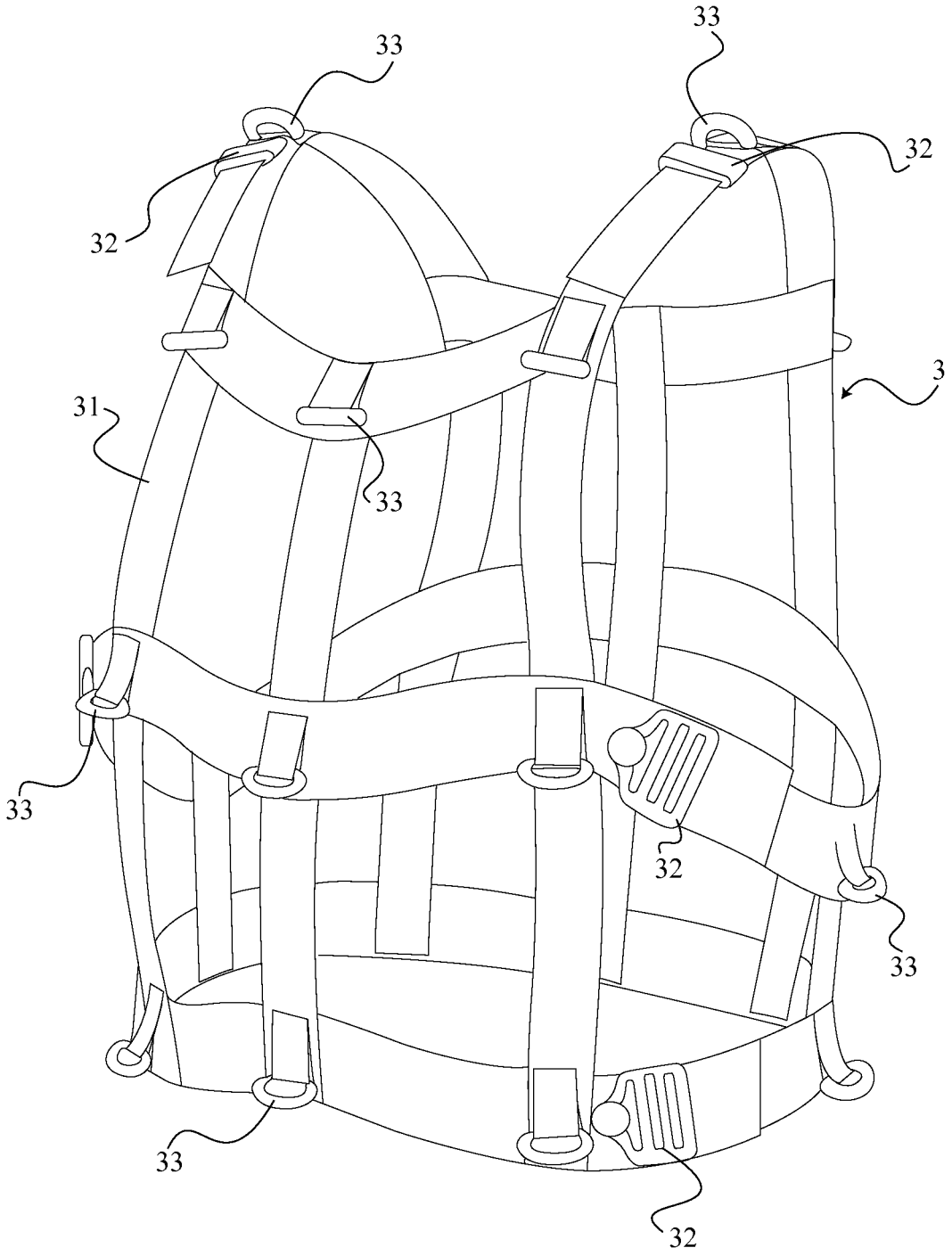
FIG. 1 is a front view in perspective of a vest that is worn in one aspect of the present invention.

The following detailed descriptions and explanations of the drawings of the d embodiments reveal the methods and apparatus of the present invention. All illustrations in the drawings are intended to aid in the descriptions herein and are not, of themselves, intended to be limiting on the scope of the invention.

Figure 17:
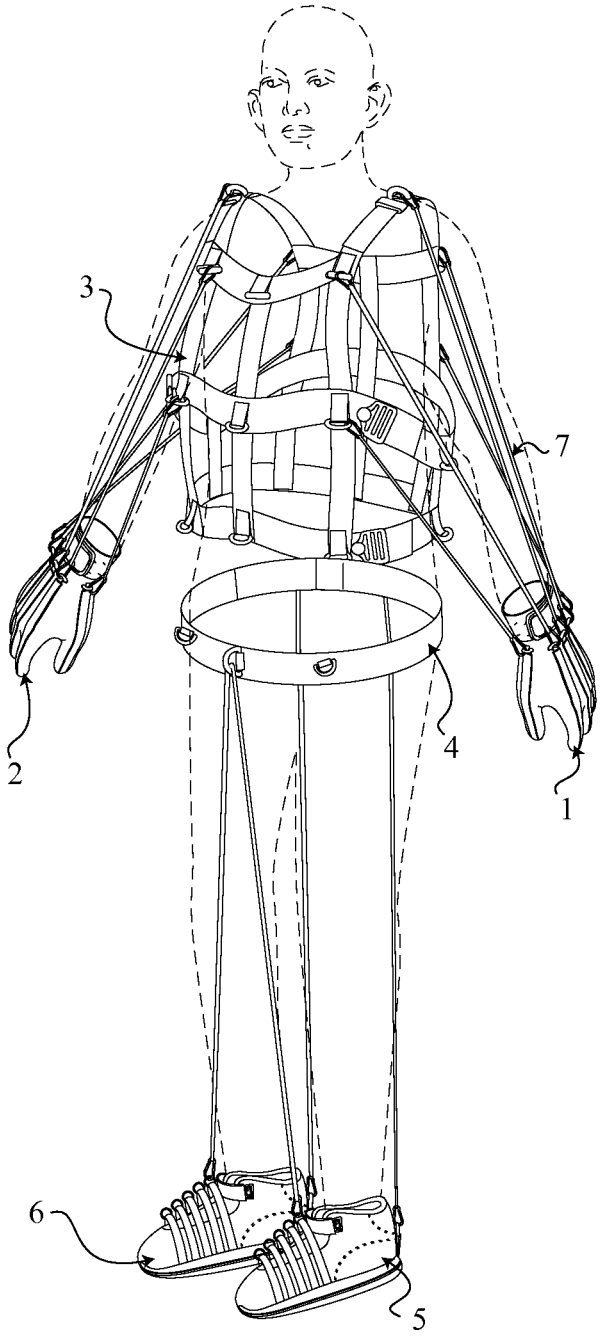
FIG. 17 is a front view in perspective of a first embodiment of the system of the present invention being worn by a user.
Figure 18:
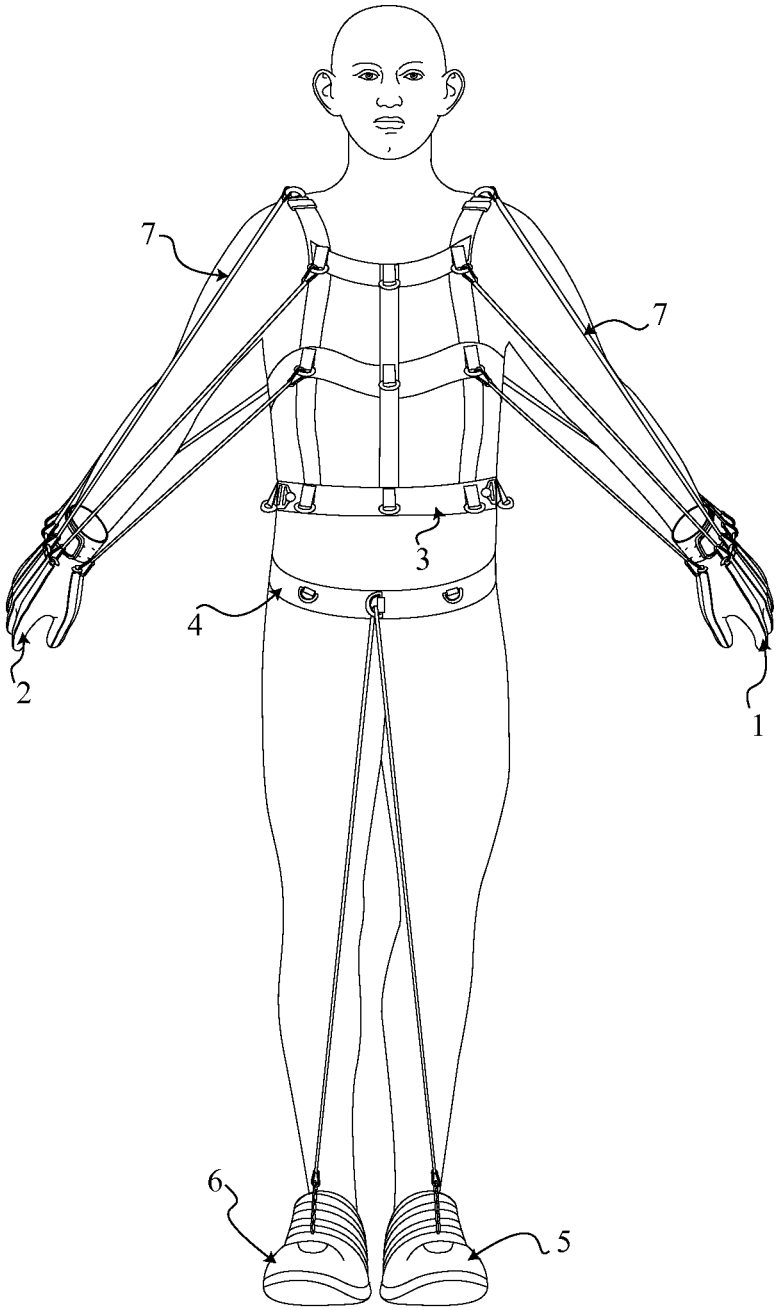
FIG. 18 is a front view in elevation of the system of FIG. 17.
Figure 19:
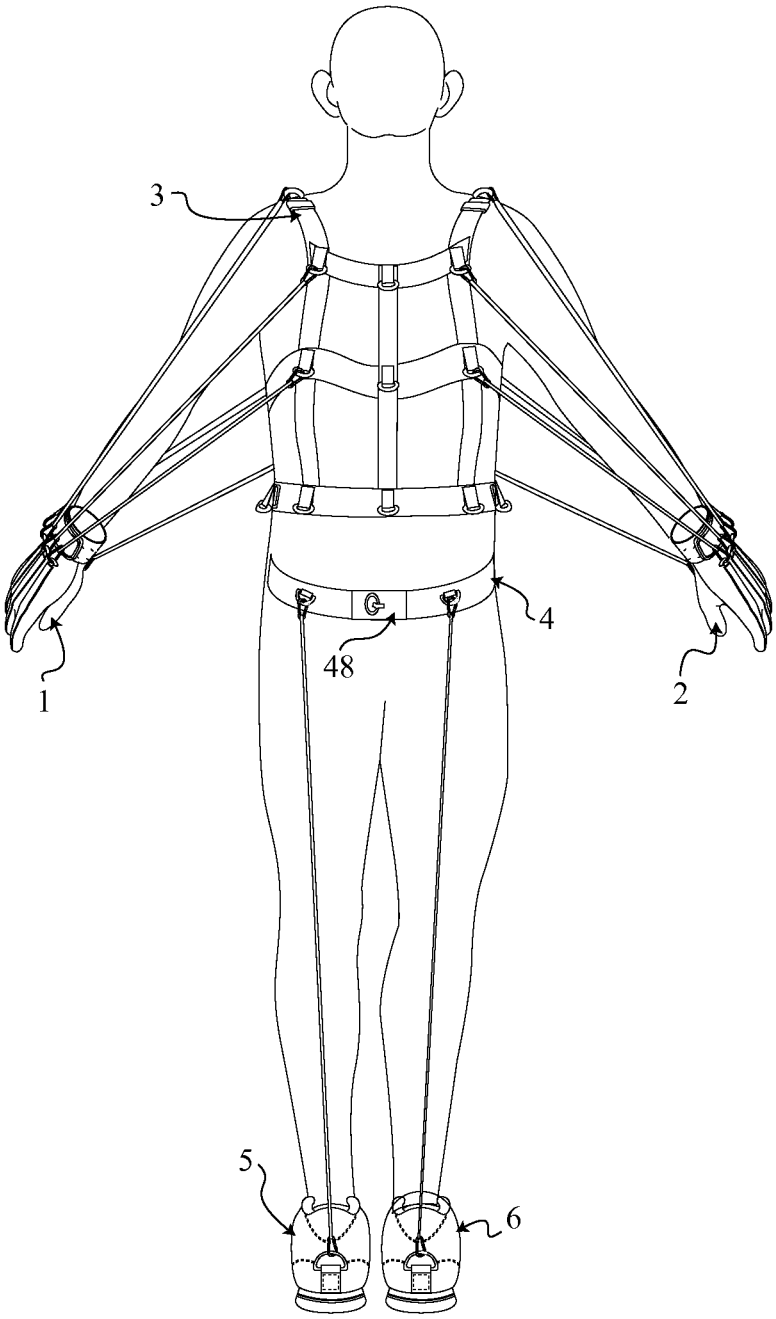
FIG. 19 is a rear view in elevation of the system of FIG. 17.

Referring initially to the system illustrated in FIGS. 17, 18 and 19, the present invention comprises a left glove 1, a right glove 2, a vest 3, a belt 4, a left shoe 5, a right shoe 6, and a plurality of resistance bands 7. The gloves 1 and 2 are attached to the vest 3 by the plurality of resistance bands 7, and the shoes 5 and 6 are attached to the belt 4 by one of the plurality of resistance bands 7. The resistance bands 7 may be provided in several different tensions, allowing for users of different strengths to use resistance bands 7 that are appropriate for to their levels of strength and the intensity of workout desired. The variety of resistance band 7 tensions also allows the user to progress up through levels of tension as his/her muscles develop greater strength through use of the system.

Figure 2:
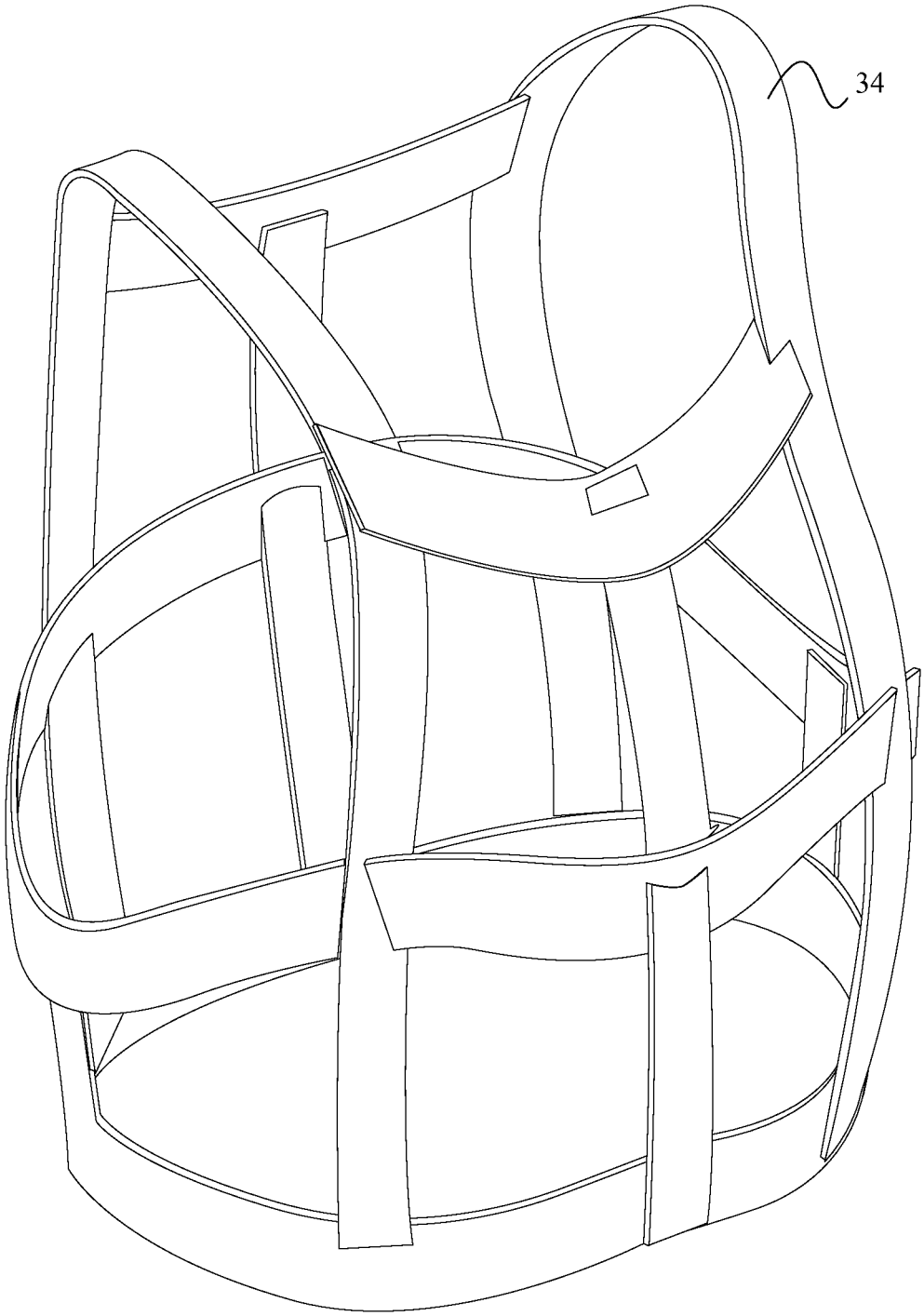
FIG. 2 is a view in perspective of a frame portion of the vest of FIG. 1.

Referring to FIGS. 1 and 2, vest 3 comprises a strap frame 31, a plurality of vest adjustable straps 32, a plurality of vest rings 33, and an inner vest frame 34. The vest 3 is worn on the user's torso, positioned around the upper body, and is secured to the user around the chest area and back area. The inner vest frame 34 is connected to the strap frame 31 from the inside surface of the strap frame. The inner vest frame 34 is made from low density viscoelastic polyurethane foam, or any other similar or related materials. Since the inner vest frame 34 is pressed against the user's body, the inner vest frame 34 deforms according the shape of the user's body; i.e., the frame substantially conforms to the user's body. The strap frame 31 is made from a plurality of straps and has a shape of a human upper body. The plurality of straps comprises a plurality (e.g., three in the illustrated example) of flexible or collapsible girth (i.e., horizontal) straps and a plurality (e.g., six in the illustrated example) of flexible or collapsible elongated (i.e., vertical) straps. The plurality of flexible girth straps is positioned perpendicular to the plurality of flexible elongated straps. Strap frame 31 is made from nylon straps or any other related materials similar to nylon so that the strap frame 31 is able to absorb multi-direction movement forces and deform according to the user's body shape (i.e., the frame remains conformed to the user's body as the user moves in exercise routines). The plurality of vest adjustable straps 32 is connected to the strap frame 31 around the strap frame left side, right side, and shoulder areas. Once the user puts on the strap frame 31, the strap frame 31 can be tightened to the user's upper torso by the plurality of vest adjustable straps 32.

In the illustrated embodiment, the plurality of vest rings 33 is movably connected to the strap frame 31 by a respective plurality of fastenings. The plurality of fastenings allows the plurality of vest rings 33 to freely move so that movement of the plurality of vest rings 33 is not entirely limited. The plurality of fastenings can be loops of material stitched, glued, riveted or any combination thereof. The plurality of vest rings 33 is positioned on the back side and the front side of the strap frame 31. Additionally, 360 degree rotatable or swivel rings can be used as the plurality of vest rings 33.

Figure 12:
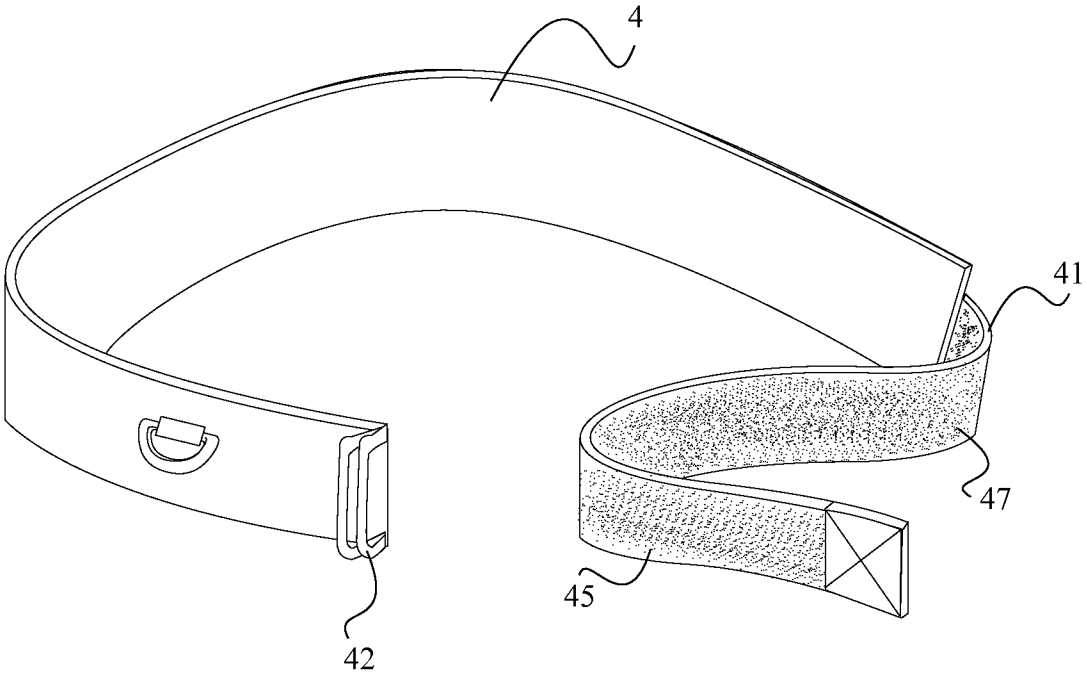
FIG. 12 is a rear view in perspective of a first embodiment of a belt that can be worn in connection with the present invention.
Figure 13:
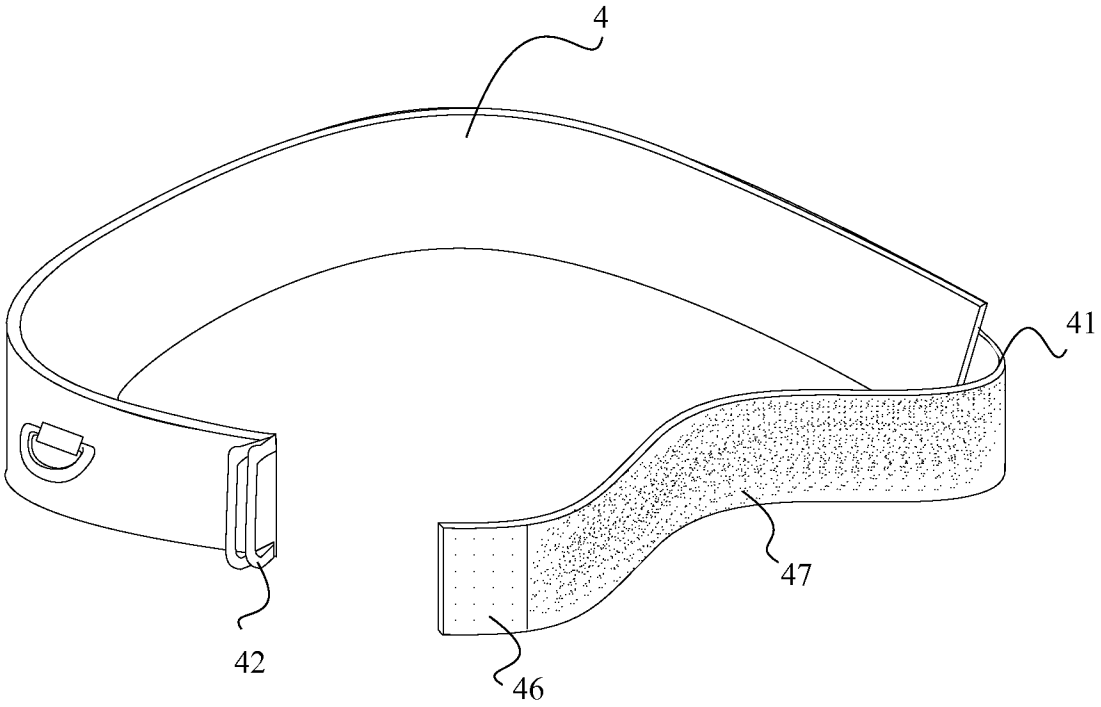
FIG. 13 is another rear view in perspective of the belt in FIG. 12 further illustrating the belt fastener.
Figure 14:
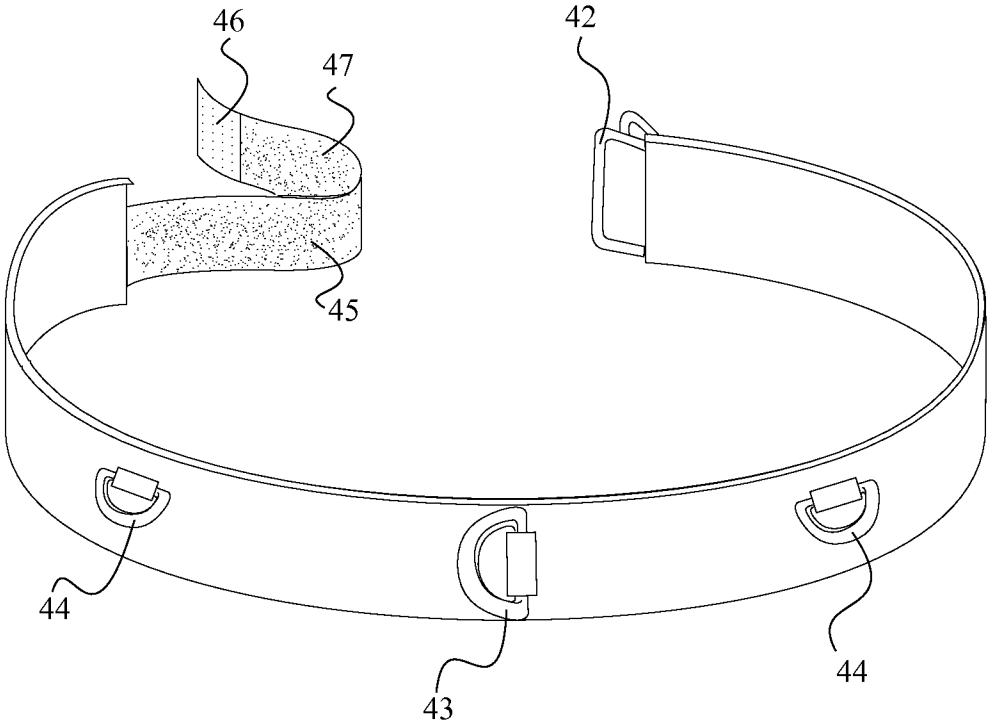
FIG. 14 is a front view of the belt in FIGS. 12 and 13.

With reference to FIGS. 12, 13, and 14, the belt 4, adapted to be worn about a user's middle or lower torso (i.e., the waist), comprises a belt adjustment strap 41, a double D-ring belt buckle 42, a plurality of vertically oriented rings 43 (i.e., rings pivotable about respective vertical axes), a plurality of horizontally oriented rings 44 (i.e., rings pivotable about respective horizontal axes), an inside belt loop fastener 45, an outside belt loop fastener 47, a belt hook fastener 46, and a back attachment 48. The double D-ring belt buckle 42 is connected to the belt 4 at a first belt end, and the belt adjustment strap 41 is connected to the belt 4 at a second and opposite belt end. The belt can be adjusted to fit by the user's waist by means of Velcro (i.e., hook and loop fastener material), whereby the outside surface of belt adjustment strap 41 comprises partially or entirely loop fastener material 47, and the outside surface of the belt fastener 46 comprises partially or entirely of hook fastener material. The inside surface 45 of strap 41 consists partially or entirely loop fastener material 45. To tighten the belt the user inserts strap 41 through the double D-ring belt buckle 42 and then between the double D-ring belt buckle 42. The hook fastener material 46 also attaches to the loop fastener material on the outside surface of strap 41 to provide additional securing of the belt 4. Since the belt adjustment strap 41 allows the user to adjust the belt 4 according to the user's girth circumference (i.e., waist size), the belt 4 can be fitted to different body structures. The plurality of horizontal rings 44 and the plurality of vertical rings 43 are movably connected to be selectively positioned along the belt 4 by the plurality of fastenings. The horizontal rings 44 and vertical rings 43 can be either D-rings or O-rings. Each horizontal ring 44 is secured to be pivotably movable at least about an axis parallel to the belt 4, and each vertical ring 43 is secured to be pivotably movable at least about an axis perpendicular to the belt 4.

Figure 15:
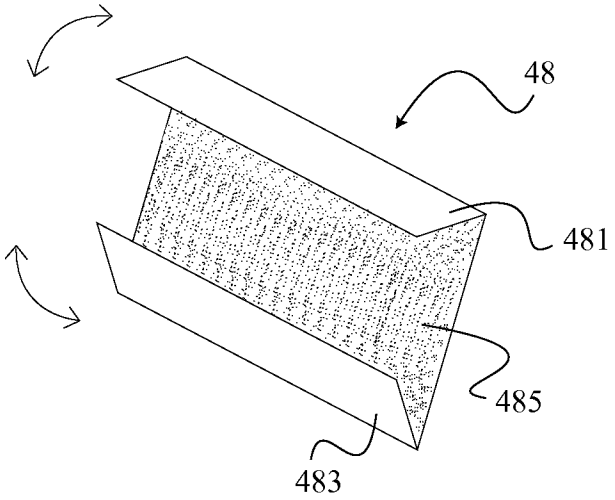
FIG. 15 is rear view in perspective of an attachment member for the belt of FIGS. 12-14.
Figure 16:
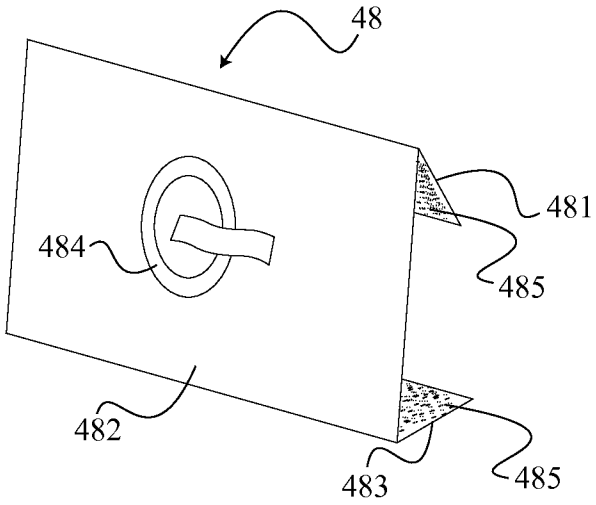
FIG. 16 is a front view in perspective of the attachment member in FIG. 15.

In reference to FIGS. 15 and 16, the back attachment 48 comprises a top flap 481, a middle flap 482, a bottom flap 483, at least one back ring 484, and a back hook material fastener 485. The top flap 481 and bottom flap 483 are respectively connected to the middle flap 482 top end and the middle flap 482 bottom end. The back ring 484 is connected to the middle flap 482 front surface. In the illustrated embodiment, an O-ring is used as back ring 484, but the back ring 484 is not limited to the O-ring configuration and can be any type of ring, such as a D-ring or triangle ring. The back hook material fastener 485 is connected to top flap 481, middle flap 482, and bottom flap 483 opposite back ring 484. With reference to FIGS. 12 and 19, the back hook fastener material 485 in the middle flap 482 of back attachment 48 attaches to the outside belt loop fastener material 47, and the back hook fastener material 485 in the top flap 481 and the bottom flap 483 attach to the inside belt loop fastener material 45.

Figure 30:
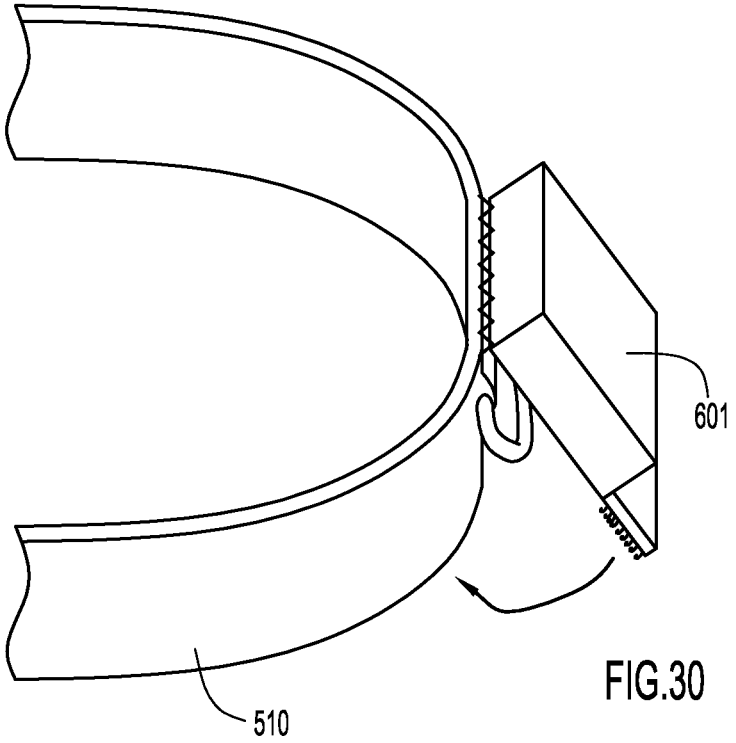
FIG. 30 is a side view in perspective showing a protective and positional stabilization pad attached to the belts of the present invention.
Figure 31:
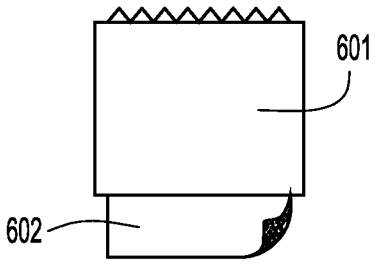
FIG. 31 is a view in elevation of the pad of FIG. 30.

An alternative belt configuration for the system includes cushioning pads or inserts 601 as illustrated in FIGS. 30 and 31 of the accompanying drawings. The cushioning (e.g., plastic foam) inserts are located at one or more locations along the belt 510 and inserted either between the inner and outer sections of the belt behind the inner part of the belt, or in front of the outer section of the belt. The foam inserts can be inserted in the front, rear, and/or sides of the belt, and are used to provide additional cushioning, comfort and spacing between the user's body and the resistance bands as the bands extend down to the lower connection points. The inserts can be made from any cushioning material and in any shape or density to provide the best and most suitable option for the user's comfort. As shown in FIG. 30, cushioning insert 601 may be stitched to the belt to assure a reliable connection. As best shown in FIG. 31, a tab may be provided at the bottom of the cushioning pad and includes a Velcro "hook" or rough surface material permitting it to engage the soft "loop" or smooth surface material comprising the back side of the belt at the pad location. If the cushioning pad were not properly secured to the belt, the pad may move during a workout by the user. Providing the tab with a rough hook surface will stop the piece from moving.

Figure 35A:
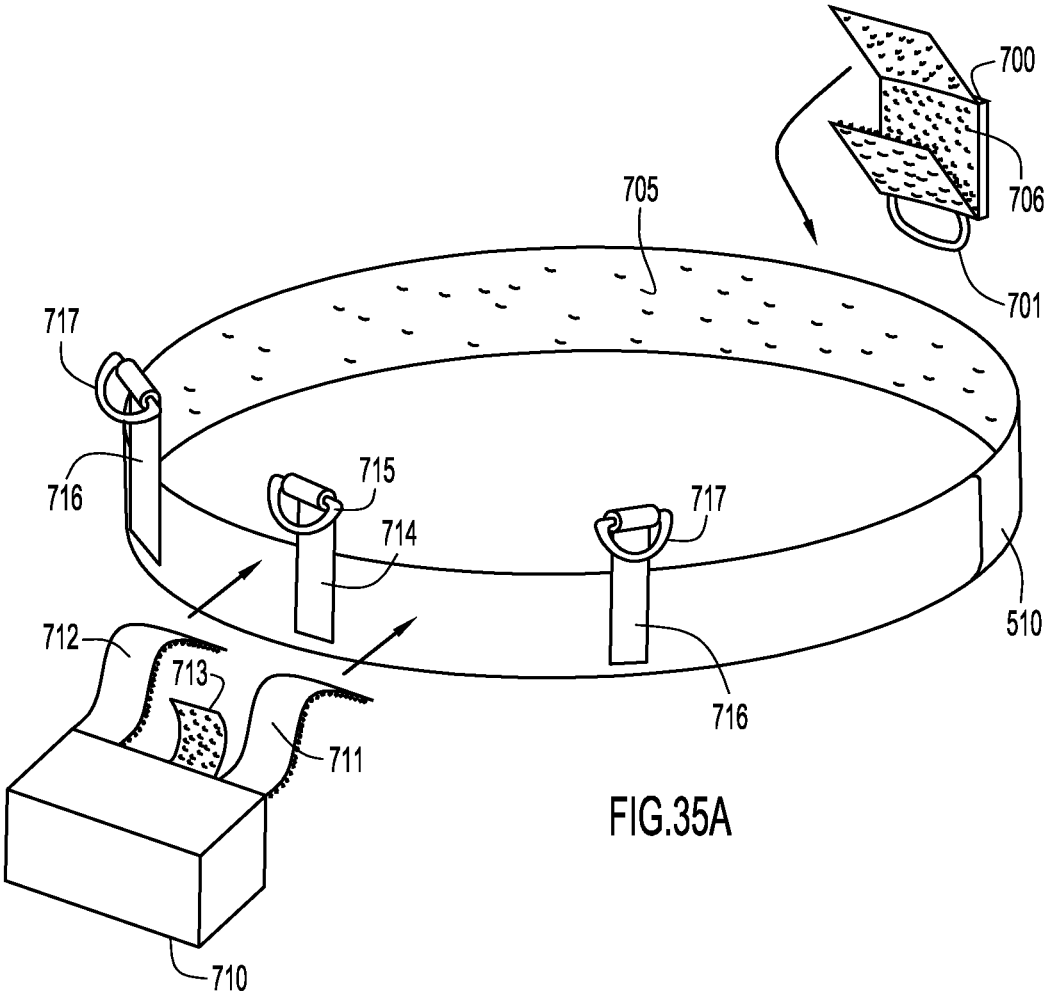
FIG. 35A is a view in perspective of the belt of FIG. 34 diagrammatically illustrating the manner of attaching a protective pad and a rear connection ring to the belt.
Figure 35B:
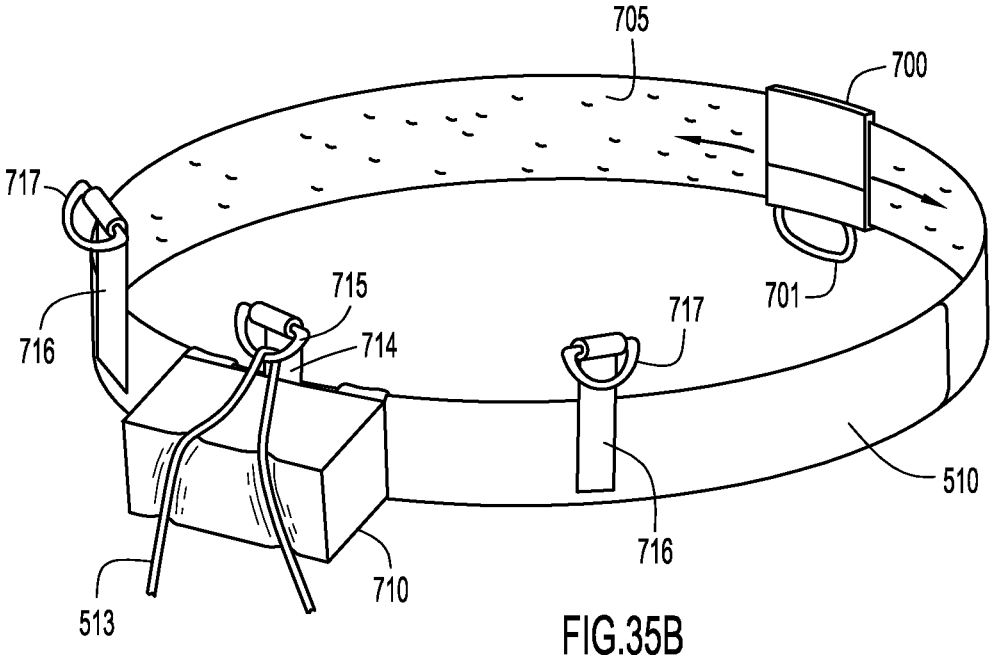
FIG. 35B is a view in perspective of the belt of FIG. 34 illustrating the protective pad and the rear connection ring attached to the belt.

Still another alternative embodiment of the belt is illustrated in FIGS. 35A and 35B to which reference is now made. The structure of belt 510 is substantially similar to belt 4 with some additional features. There are three front band connections rings secured to belt 510 in a manner such that the rings are supported above the top edge of the belt. Specifically, a center ring 715 is supported by support member 714 at the center of the front of the belt. Left and right side rings 717 are spaced on either side of center ring 715 and supported by respective support members 716. Support members 714 and 716 may be strips of material that are secured to the outer surface of the belt and extend across the belt width to a height slightly above the upper belt edge. Alternatively, for an even stronger attachment to the belt, the support members may be stitched or otherwise secured in place between the inner and outer layer of the belt. The upper ends of the support members are looped to surround the straight sides of respective D-rings 715, 717 so that the rings are free to pivot in the loop about their own axes which are oriented horizontally when the belt is worn. This location of the rings above belt 510 serves to position resistance bands, when they are connected to the rings, away from the user's body.

To space the bands even further from the user's body, particularly the user's groin area, a protective pad 710 may be selectively attachable to the belt in front of and below center connection ring 715. Pad 710 is made from a plastic foam or other cushioning material and has two spaced top connecting straps 711, 712 secured to and extending proximally from opposite ends of the upper edge of the proximal side of pad 710. A bottom connecting strap 713 extends proximally from the center of the lower edge of the proximal side of the pad. The inner surfaces of straps 711, 712 and 713 are provided with hook attachment material suitable to engage the loop attachment material that is disposed on the inner surface of belt 510. The spacing between the two top connecting straps 711 and 712 is wider than the width of support member 714 and its supported connection ring 715 so that straps 711, 712 do not interfere with ring 714 and any resistance band connected to or passing through that ring. When straps 711, 712 and 713 are engaged with the inner belt surface, pad 710 projects forwardly of the front center of belt below connection ring 715 to project the resistance band forward from the belt and the user's body. The thickness of the pad is typically approximately two inches but can be anywhere in the range of about one to three inches as needed to effect the desired forward projection of the resistance band. Although illustrated such that the pad, when attached to the belt, has its upper surface substantially coplanar with the upper edge of the belt, for some embodiments it may be desirable to extend the upper surface of the pad above the belt upper edge to achieve even greater spacing of the resistance bands from the user's body.

The back ring 701 for belt 510 is secured to a removable and positionally adjustable attachment panel unit 700. Panel 700 includes three sections (upper, middle and lower) that are mutually foldable onto one another and has an interior surface provided with hook attachment material suitable to engage the loop attachment material that is disposed on the inner surface of belt 510. The outer surface of at least the lower panel is provided with loop attachment material suitable to engage the hook attachment material that is disposed on the inner surface of the upper section when it is folded over onto the lower section with the belt 510 disposed between the lower and middle sections. Back connection ring 701 projects from the outside surface of panel unit 700 at the fold juncture between the middle and lower panel sections. The back connection ring is preferably a D-ring and is engaged by unit 700 to be pivotable about the axis of its straight leg which is oriented horizontally when the unit is secured to the belt. In this position the back connection ring 701 projects downwardly from the belt. The removable and adjustably positionable panel unit 700 permits the user of the belt, after the belt is tightened or loosened to accommodate the user's waist size, to install the back ring at the center of his/her back, irrespective of the user's waist size.

Figure 9:
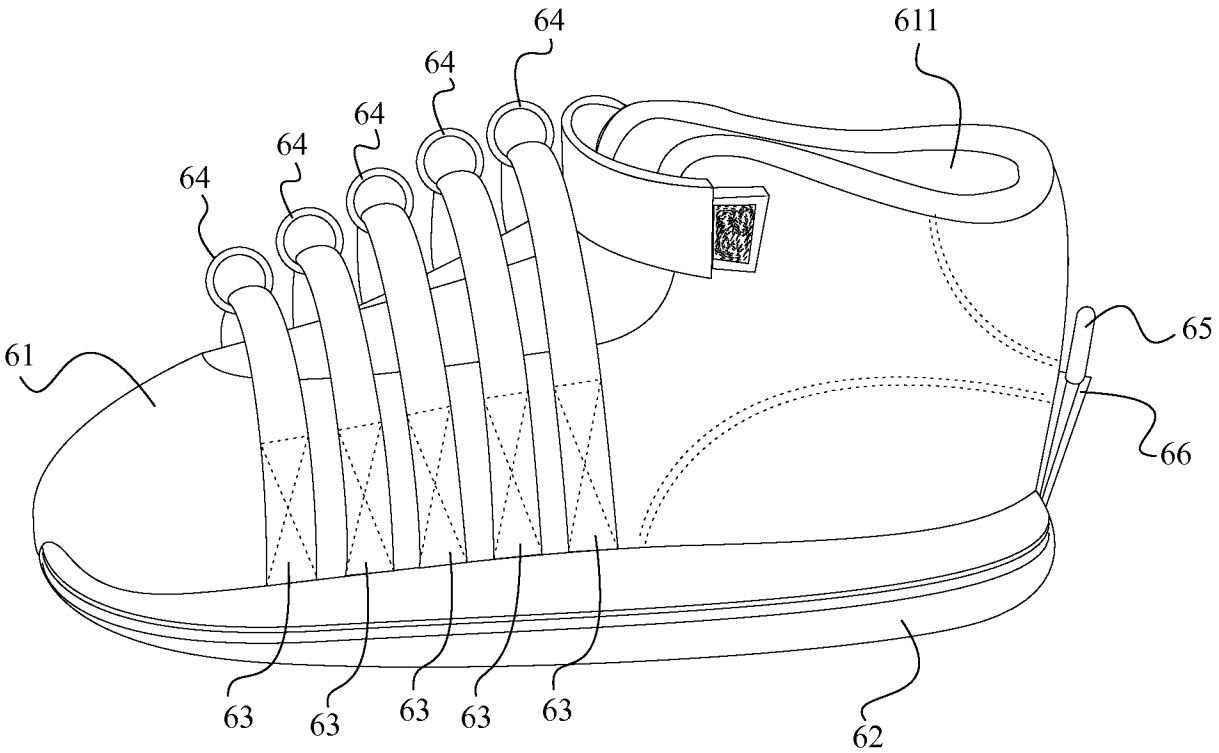
FIG. 9 is a side view in perspective of a shoe that can be worn in connection with the present invention.
Figure 10:
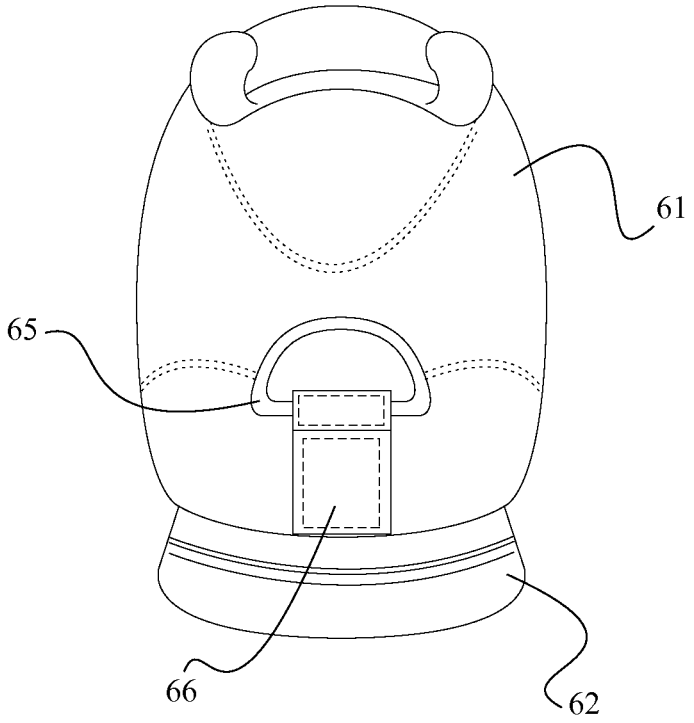
FIG. 10 is a rear view of the shoe of FIG. 9.

With reference to FIGS. 9 and 10, there is illustrated a shoe which may be either of the shoes 5 or 6 illustrated in FIG. 17. The shoe may be any athletic-type shoe appropriate for the desired conditioning activity including, but not limited to, a general cross-training shoe, or an athletic shoe, including a cleated shoe, made specifically for any particular sport. The shoe comprises an upper section 61, a sole 62, a plurality of shoe straps 63, a plurality of connection O-rings 64, a rear ring 65, and a ring attachment member 66. The upper 61 includes a heel opening 611 through which a user can insert his/her foot so that the shoe can be attached to (i.e., worn on) the foot. The shoe straps 63 may be ballistic nylon or similarly strong and inelastic material and are positioned in spaced relation in front of the heel opening 611 and rearwardly of the front tip of the shoe above the user's instep. In this embodiment each of the straps 63 is a single continuous loop which is positioned around and connected to the upper section 61, by stitching, adhesive, or the like, proximate (i.e., immediately above) the junction between the shoe upper 61 and sole 62. Each shoe strap 63 is stitched to the upper section 61 left side and right side in the illustrated embodiment, but may alternatively be secured to the sole or secured between an insole and outsole comprising sole 62. Connection rings 64 are positioned to encircle respective shoe straps 63. The straps 63 are provided with sufficient slack to leave enough space between the strap and the shoe upper 61 to enable connection rings 64 to freely move along the straps 63 between the stitched ends of the straps on the left and right side of upper 61. The ring attachment member 66 is positioned behind the heel opening 611, preferably on the outer rear surface of the shoe, and perpendicularly positioned relative to the plurality of straps 63. The ring attachment 66 bottom end is connected to the upper section 61 back side and bottom side, and the rear ring 65 is pivotably connected to the ring attachment member 66 top end. The sole 62 is connected to the bottom side of the upper section 61 along a junction line. The sole 62 provides additional support to the plurality of straps 63 and the ring attachment member 66 so that the plurality of shoe straps 63 and the ring attachment member 66 are secured within the shoe.

Additionally, the plurality of straps 63 can also be attached to the shoes 5 and 6 by implementing a male/female strap clip system. The male/female strap clip system allows the plurality of shoe straps 63 to attach with the shoe, and the plurality of shoe straps 63 would not be in the form of a continuous loop. If the shoe has the male/female strap clip system, male strap clips connect with the each of straps 63, and a plurality of female strap clips connect with shoe. The user can simply insert the male strap clips into the plurality of female strap clips, securing the plurality of shoe straps 63 to the shoe 6. The male/female strap clip system also allows the user to adjust the lengths of the straps 63.

Additionally, the plurality of shoe straps 63 can be attached to the left shoe 5 and the right shoe 6 by a plurality of channel connectors. The plurality of channel connectors is positioned between the upper section 61 and the sole 62. Each of the plurality of channel connectors comprises an inside channel, an outside channel, and a connector segment. The inside and outside channels are perpendicularly connected to the connector segment, and only at the connector segment positions under the upper section 61. Each of the plurality of shoe straps 63 is adjustably attached with the inside channel and the outside channel, allowing users to interchange the plurality of shoe straps 63 according to different exercises.

Figure 32:
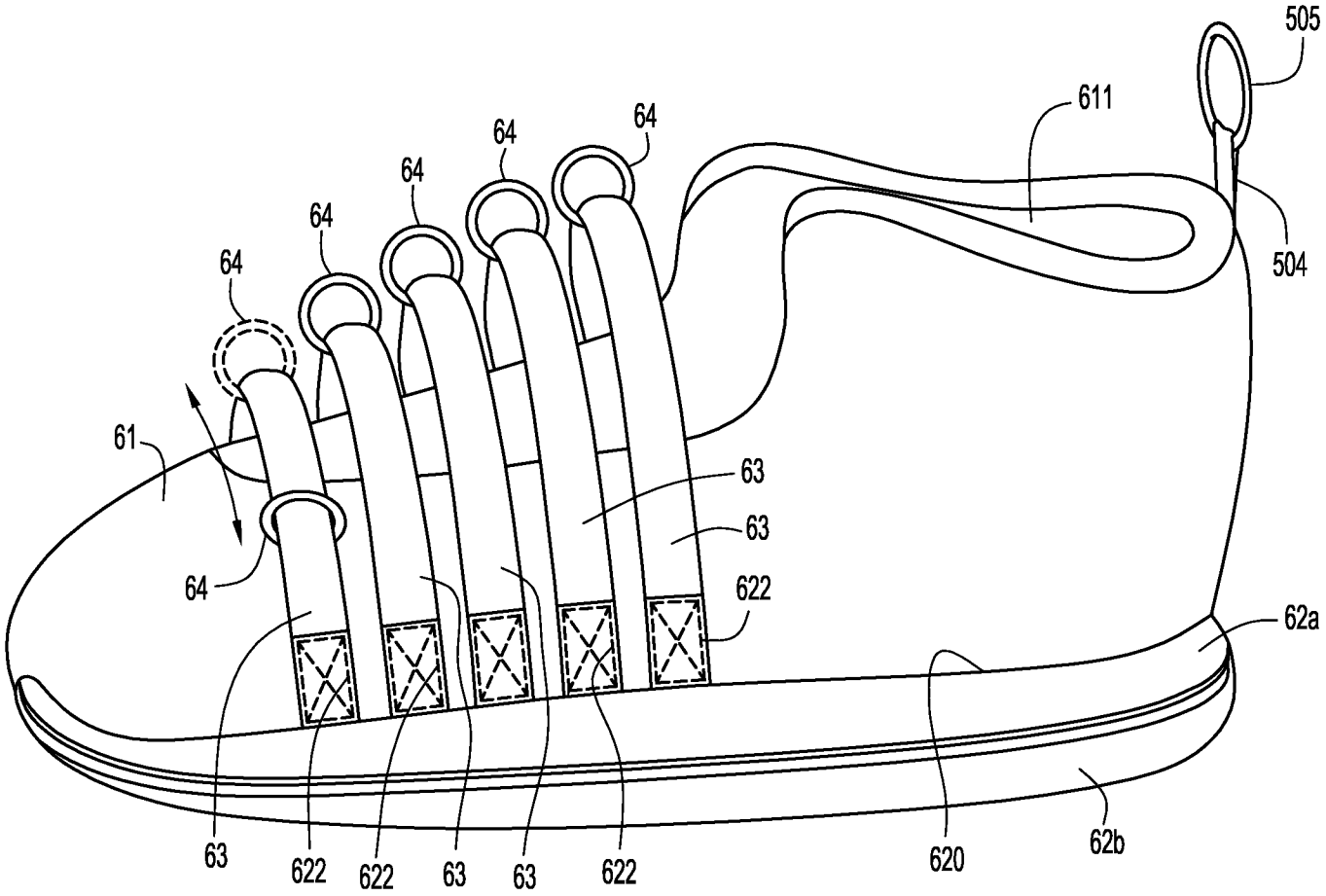
FIG. 32 is a side view in perspective of another shoe that can be worn in connection with the present invention.
Figure 33B:
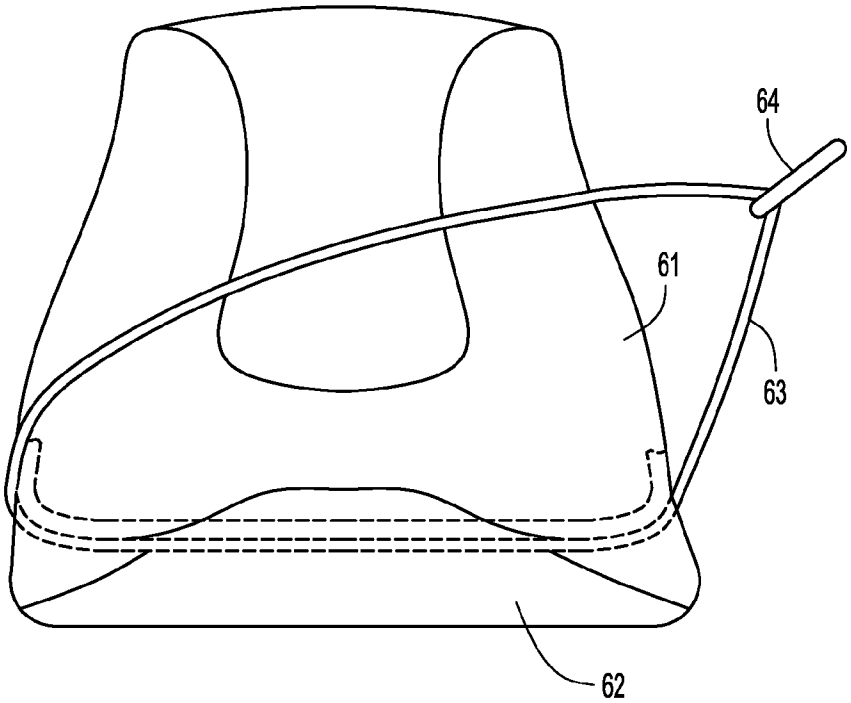
FIG. 33B is a front view on elevation of the shoe of FIG. 32 showing a strap and connection ring in two of the possible applied force positions.
Figure 33A:
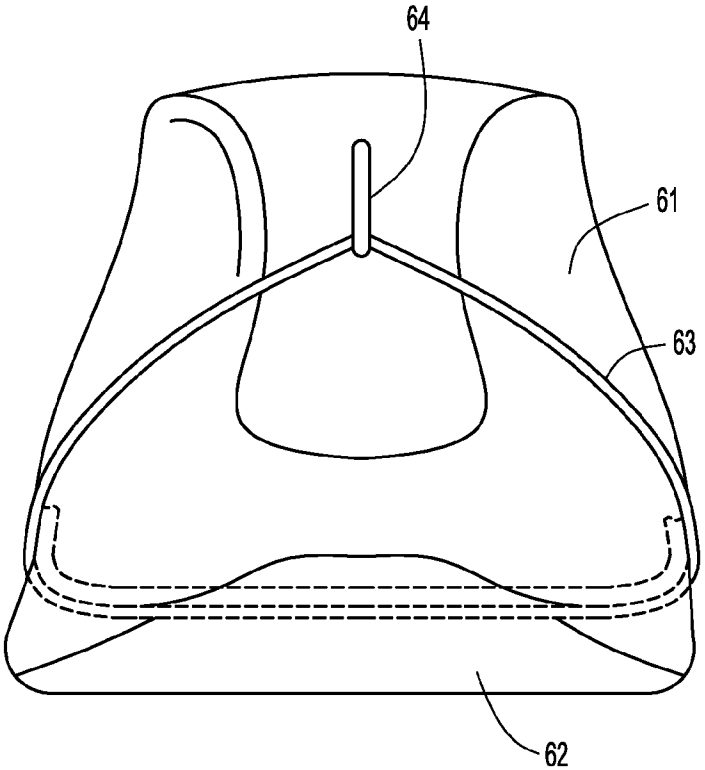
FIG. 33A is a front view on elevation of the shoe of FIG. 32 showing a strap and connection ring in a force-neutral position.

Referring to FIGS. 32, 33A and 33B, another embodiment of the shoe 5 or 6 is illustrated. The shoe may be any athletic-type shoe appropriate for the desired conditioning activity. The shoe comprises a shoe body having a forward portion and a rearward portion, an upper section 61 and a sole including conventional insole 62*a* and outsole 62*b* joined to the shoe upper along a junction 620 between them. A plurality of straps 63 is provided, each strap extending over the forward portion of the shoe between two locations on junction 620 on opposite sides of the shoe upper 61. The straps are essentially parallel to and spaced rearwardly from one another along said shoe body. The straps are made of a strong material such as ballistic nylon or similar material and have sufficient slack so as to be loosely spaced above the shoe upper. A corresponding plurality of connection rings 64 is disposed about and freely movable along respective straps 63. Each ring 64 and the strap 63 it surrounds are configured and constructed to be connected, via the ring, to an elastic resistance band 513 (FIG. 34) such that, when the connected ring is pulled by a force applied through the elastic resistance band, the ring is free to both traverse the strap 63 and pull the strap in the direction of band. The slack in strap 63 is sufficient to permit the ring to be pulled with the second strap transversely outwardly of the shoe beyond the junction between the shoe upper 61 and the sole 621, 62*b*.

In the illustrated embodiment each strap 63 is a continuous loop extending beneath the insole 62*a* and the outsole 62*b* and above the shoe upper 61. However, the strap need not be continuous, the important feature being its transversely spaced connections 622 to opposite sides of upper 61 at or immediately above the junction 620 by stitching, adhesive or other means. These transversely spaced connections 622 permit the band to be pulled transversely outwardly of the shoe as described above and illustrated in FIG. 33B. Thus, each strap can have a finite length, terminating at junction 620, and still function as described.

Whether or not the straps are continuous, because of the spaced connection locations 622 on opposite sides of the shoe, the strap directs the tension force in the resistance band in a balanced manner to both sides of the foot, uniformly distributing the force and avoiding torque that is produced in prior art systems where the force is applied in an unbalanced manner, primarily to one side of the foot. Such torque tends to turn the user's foot in a roll direction which can cause serious injury. In addition, uneven force distribution results in inefficient transmission of the tension force and requires more tension to accomplish a given exercise.

The stitching of the straps 63 to upper section 61 at connections 622 is advantageously of the Box X type which is known to have particular strength, but other strong stitching may be utilized.

Another important feature of the shoe of FIG. 32 is the provision of plural straps 63 at different locations lengthwise of the shoe and the user's foot, thereby providing the user with options as to which strap and ring to use for a particular exercise. In this regard, at least the forwardmost strap is located forward of the arch portion of the shoe sole and the user's foot, approximately at the balls of the user's foot. Resistance band tension applied at this location is ideal for training for straight ahead running and similar activities. The rearwardmost strap is located slightly forward of the shoe opening 611 corresponding to a location above the rearward part of the user's instep. Resistance band tension applied at this location is ideal for training for lateral movement and sudden directional changes. Two or more additional straps are located over the instep intermediate the forward and rearward straps and can be selected for combined training and/or user comfort at various exercise sessions.

Figure 34:
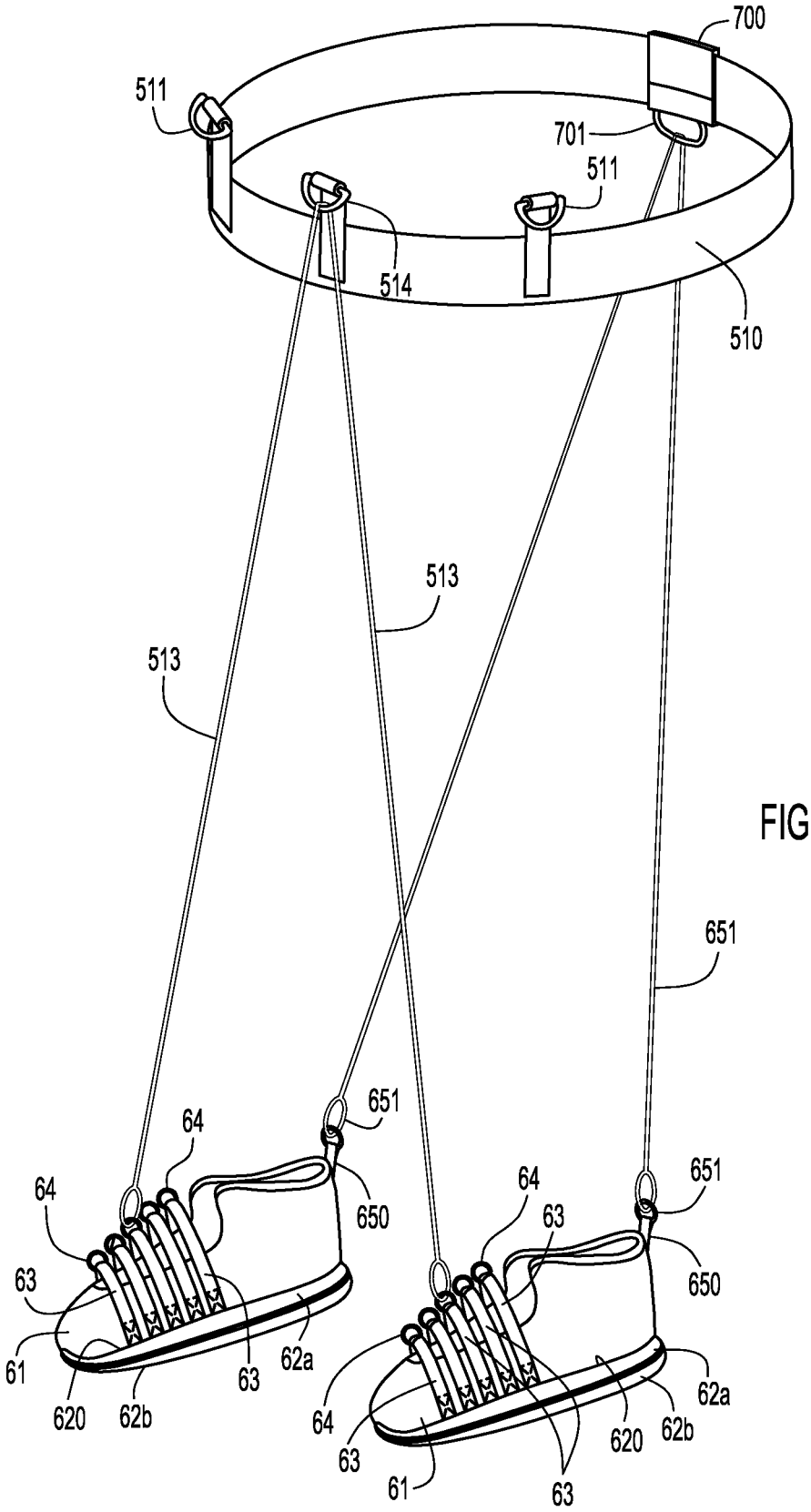
FIG. 34 is a view in perspective showing two of the shoe of FIG. 32 and a belt according to the invention connected via elastic resistance bands.

As illustrated if FIG. 34, each shoe may also include a rear tab 650 extending upward along the back of the shoe to a location above heel opening 611. Tab 650 retains a rear ring 651 at its upper end, which is adapted to engage another resistance band 651.

FIG. 34 also illustrates a system embodiment of the present invention without a vest, wherein the only item or garment worn on the user's torso is belt 510. The arrangement, as shown, permits exercise of the user's feet and legs. A front resistance band 513 extends between a selected connecting ring 64 on the left shoe and a selected connecting ring 64 on the right shoe through the front center belt ring 514 extending upwardly from the belt. A rear resistance band 651 extends between the rear ring 651 on each shoe through the back centered ring 701 projecting downwardly from the belt. The user can connect the ends of front band 513 to any of the plural connection rings 64 on either shoe, depending on the particular intended exercise and the user's subjective "feel" or comfort.

Figure 3:
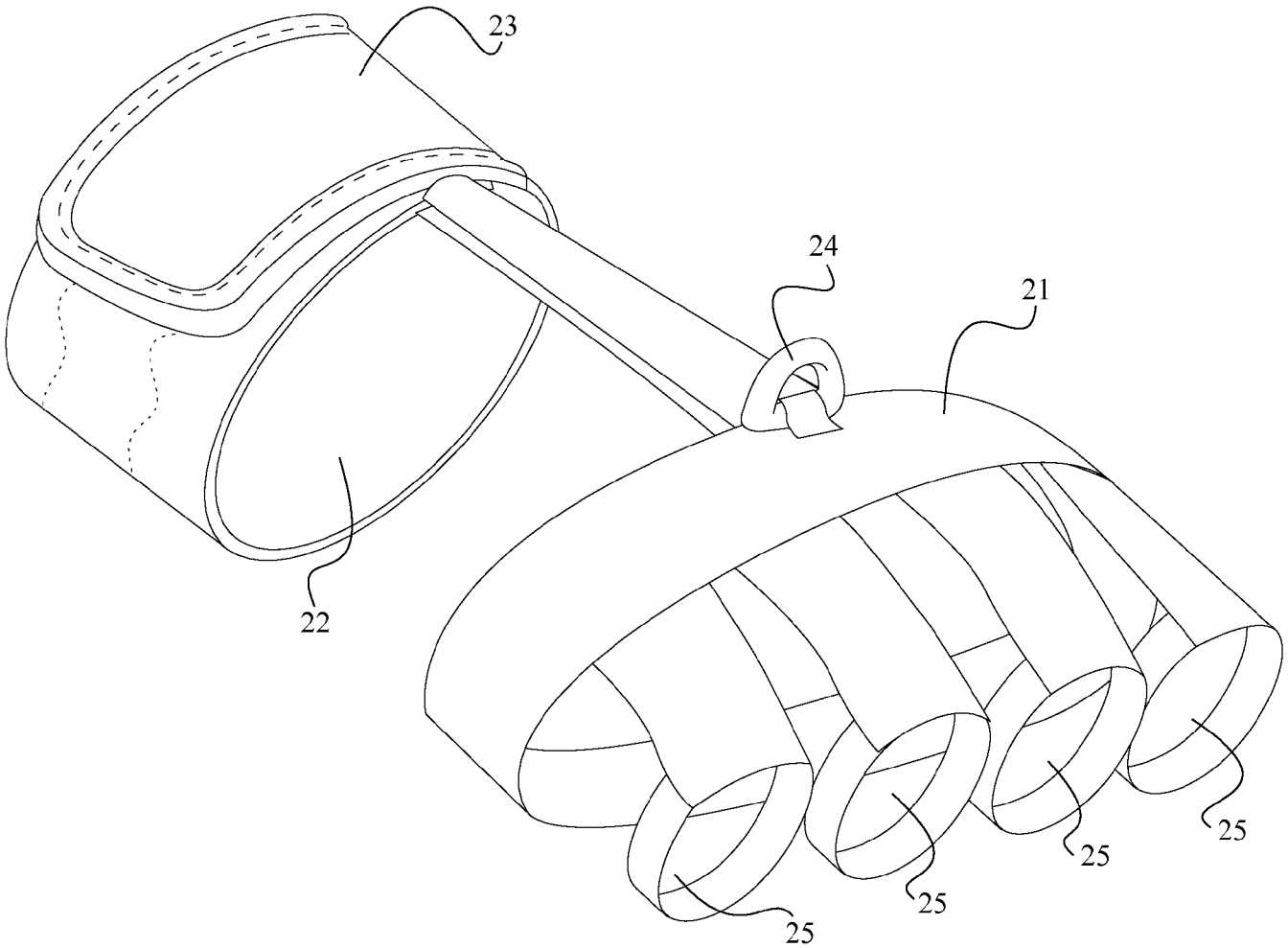
FIG. 3 is a front view in perspective of first embodiment of a glove that can be worn in connection with the present invention.

In reference to FIG. 3, left glove 1 and right glove 2 in the first embodiment each comprises a glove support structure 21, a wrist opening 22, a wristband 23, a glove D-ring 24, and a plurality of finger openings 25. The wristband 23 is connected to glove support structure 21 from one end, and the plurality of finger openings 25 is connected to the glove support structure 21 opposite the wristband 23. The glove support structure 21 is made from many individual straps and comprises the shape of a human hand. The wrist opening 22 is positioned within the wristband 23. When a user inserts his hand through the wrist opening 22 into the glove support structure 21, the user's fingers extend through the plurality of finger openings 25. The wristband 23 allows the user to adjust the comfort fit of the glove. The wristband 23 comprises a first end 231, a second end 232, an adjustable wrist strap 233, glove loop fastener material 234, and glove hook fastener material 235. The adjustable wrist strap 233 is connected to wristband 23 from the first end 231 and positioned on the outside surface of the wristband 23. The glove hook fastener material 235 is connected to the second end 232 from the outside surface of the wristband 23. The glove loop fastener material 234 is positioned between adjustable wrist strap 233 and glove hook fastener material 235, and glove loop fastener material 234 is connected to adjustable wrist strap 233. Since the first end 231 and second end 232 are attached together by glove hook fastener material 235 and glove loop fastener 234, users can adjust the circumference of the wristband 23 by means of the adjustable wrist strap 233. The glove D-ring 24 is movably connected to the glove support structure 21. The glove D-ring 24 is positioned adjacent the plurality of finger openings 25 and positioned on the glove support structure 21 top side, wherein the top side is positioned adjacent the hand knuckles and the wrist.

Figure 4:
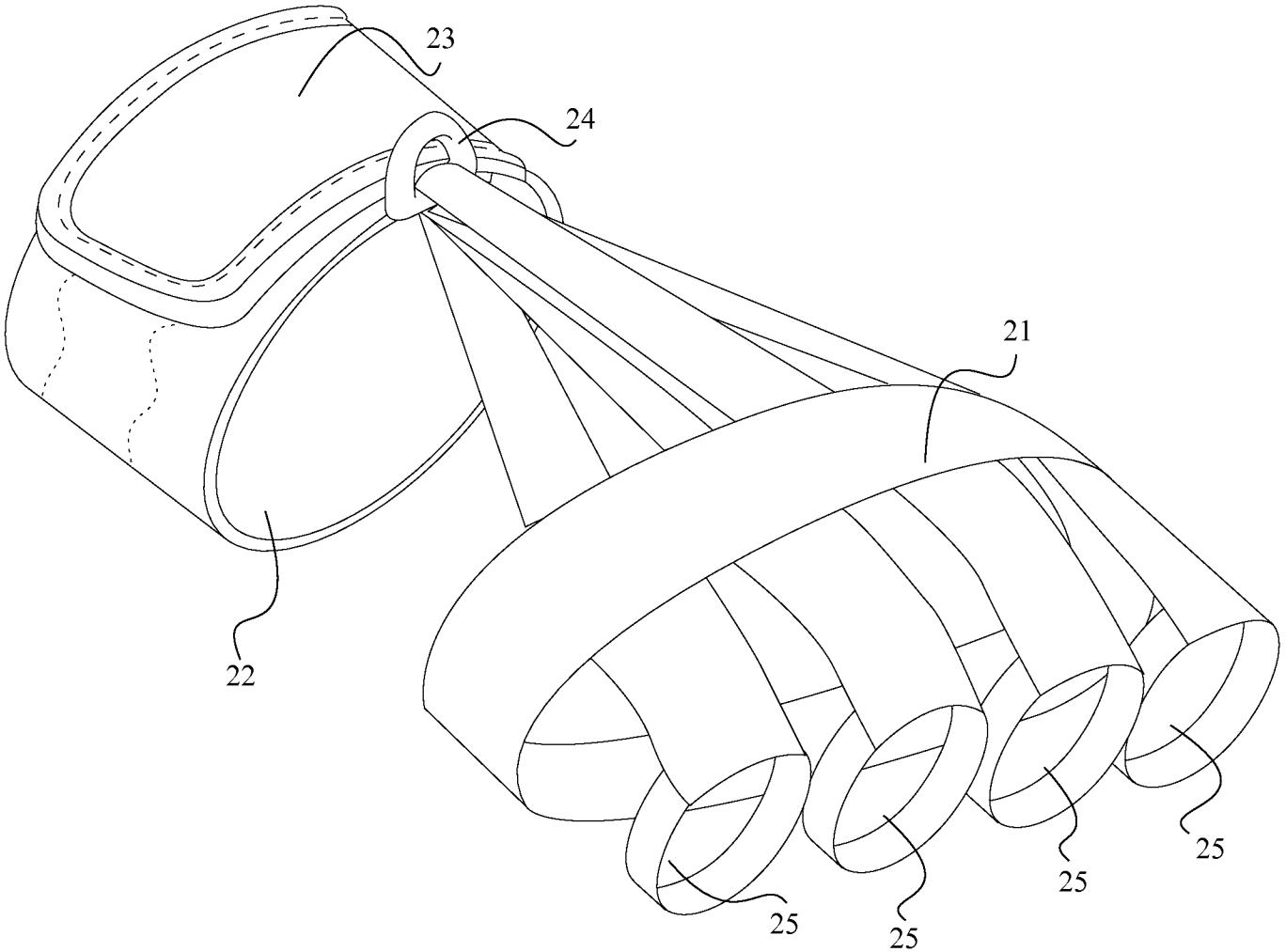
FIG. 4 is a front view in perspective of a second embodiment of a glove that can be worn in connection with the present invention.

In reference to FIG. 4, the left glove 1 and right glove 2 in the second embodiment each comprises the glove support structure 21, wrist opening 22, wristband 23, glove D-ring 24, and the plurality of finger openings 25. The wristband 23 is connected to glove support structure 21 from one end, and the plurality of finger openings 25 is connected to glove support structure 21 opposite the wristband 23. The glove support structure 21 is made from many individual straps and comprises the shape of a human hand. The wrist opening 22 is positioned within the wristband 23. When a user inserts a hand through wrist opening 22 into glove support structure 21, the user's fingers extend through the plurality of finger openings 25. The wristband 23 allows the user to adjust the comfort fit of the glove. The wristband 23 comprises the first end 231, the second end 232, adjustable wrist strap 233, glove loop fastener 234, and glove hook fastener 235. The adjustable wrist strap 233 is connected to wristband 23 from the first end 231 and positioned on the outside surface of the wristband 23. The glove hook fastener 235 is connected to the second end 232 from the outside surface of the wristband 23. The glove loop fastener material 234 is positioned between the adjustable wrist strap 233 and the glove hook fastener material 235, and the glove loop fastener material 234 is connected to the adjustable wrist strap 233. Since the first end 231 and the second end 232 are attached together by the glove hook fastener 235 and the glove loop fastener 234, users can adjust the circumference of the wristband 23 by the adjustable wrist strap 233. The glove D-ring 24 is pivotably connected to the glove support structure 21. The glove D-ring 24 is positioned adjacent the wristband 23 and positioned on the glove support structure 21 top side, wherein the top side is positioned adjacent the hand knuckles and the wrist.

Figure 5:
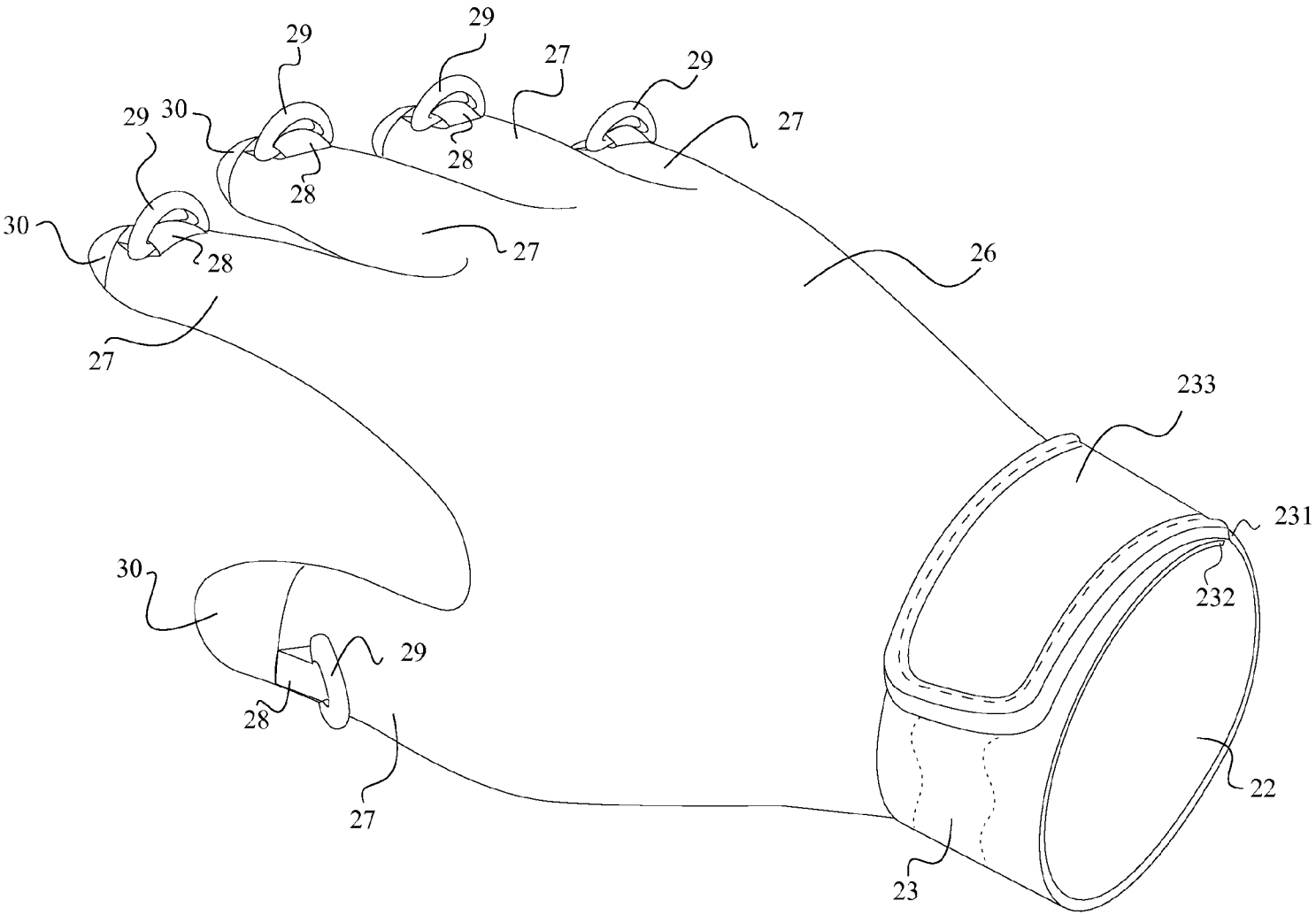
FIG. 5 is a rear view in perspective of a third embodiment of a glove that can be worn in connection with the present invention.
Figure 6:
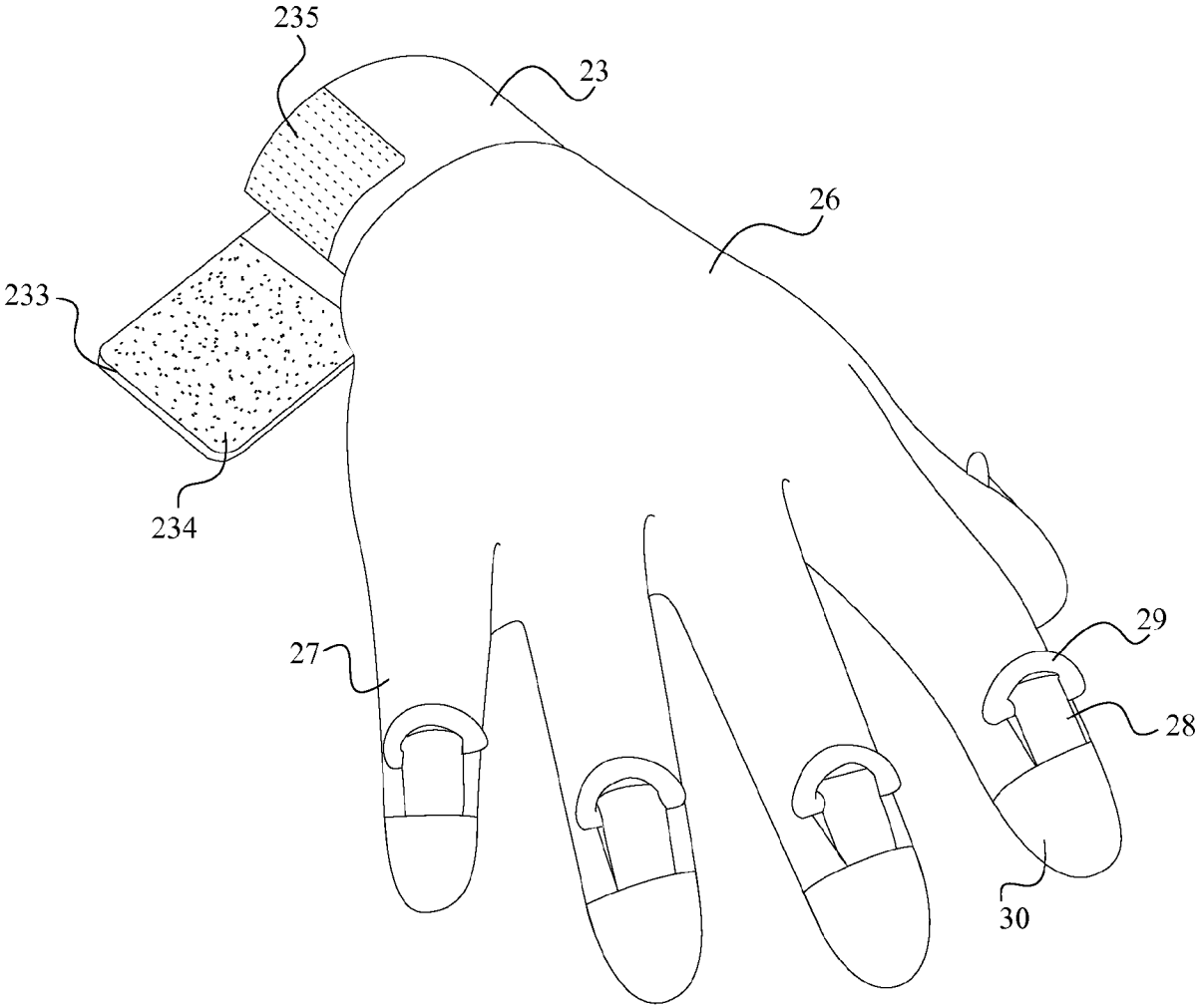
FIG. 6 is a front view in perspective of the glove in FIG. 5.

Referring to FIGS. 5 and 6, left glove 1 and right glove 2 in the third embodiment each comprises an inner glove 26, a plurality of fingertip connectors 28, a plurality of glove D-rings 29, and a fingertip connector cover 30. The inner glove 26 comprises the wrist opening 22, a plurality of finger sleeves 27, and wristband 23. The wristband 23 is connected to inner glove 26 from one end, and the plurality of finger sleeves 27 is positioned with inner glove 26 opposite from wristband 23. The inner glove 26 is made out of high strength stretchable fabric, and comprises the shape of a human hand. The wrist opening 22 is positioned within the wristband 23. When a user inserts a hand through the wrist opening 22 into the inner glove 26, the user's fingers traverse into the plurality of finger sleeves 27. The wristband 23 allows the user to adjust the comfort fit of the glove. The wristband 23 comprises first end 231, second end 232, adjustable wrist strap 233, glove loop fastener material 234, and glove hook fastener material 235. The adjustable wrist strap 233 is connected to the wristband 23 from the first end 231 and positioned on the outside surface of wristband 23. The glove hook fastener material 235 is connected to second end 232 from the outside surface of wristband 23. The glove loop fastener material 234 is positioned between adjustable wrist strap 233 and glove hook fastener material 235, and glove loop fastener material 234 is connected to adjustable wrist strap 233. Since the first end 231 and the second end 232 are attached together by glove hook fastener material 235 and glove loop fastener material 234, users can adjust the circumference of the wristband 23 by means of adjustable wrist strap 233. The plurality of fingertip connectors 28 is firmly connected with the plurality of finger sleeves 27 around the fingernails, and each of the plurality of glove D-rings 29 is pivotably connected with the plurality of fingertip connectors 28 from the free end. In the third embodiment, the plurality of glove D-rings 29 is positioned adjacent the fingernails of the user. The fingertip connector cover 30 is positioned over the plurality of fingertip connectors 28 and connected to the inner glove 26.

Figure 7:
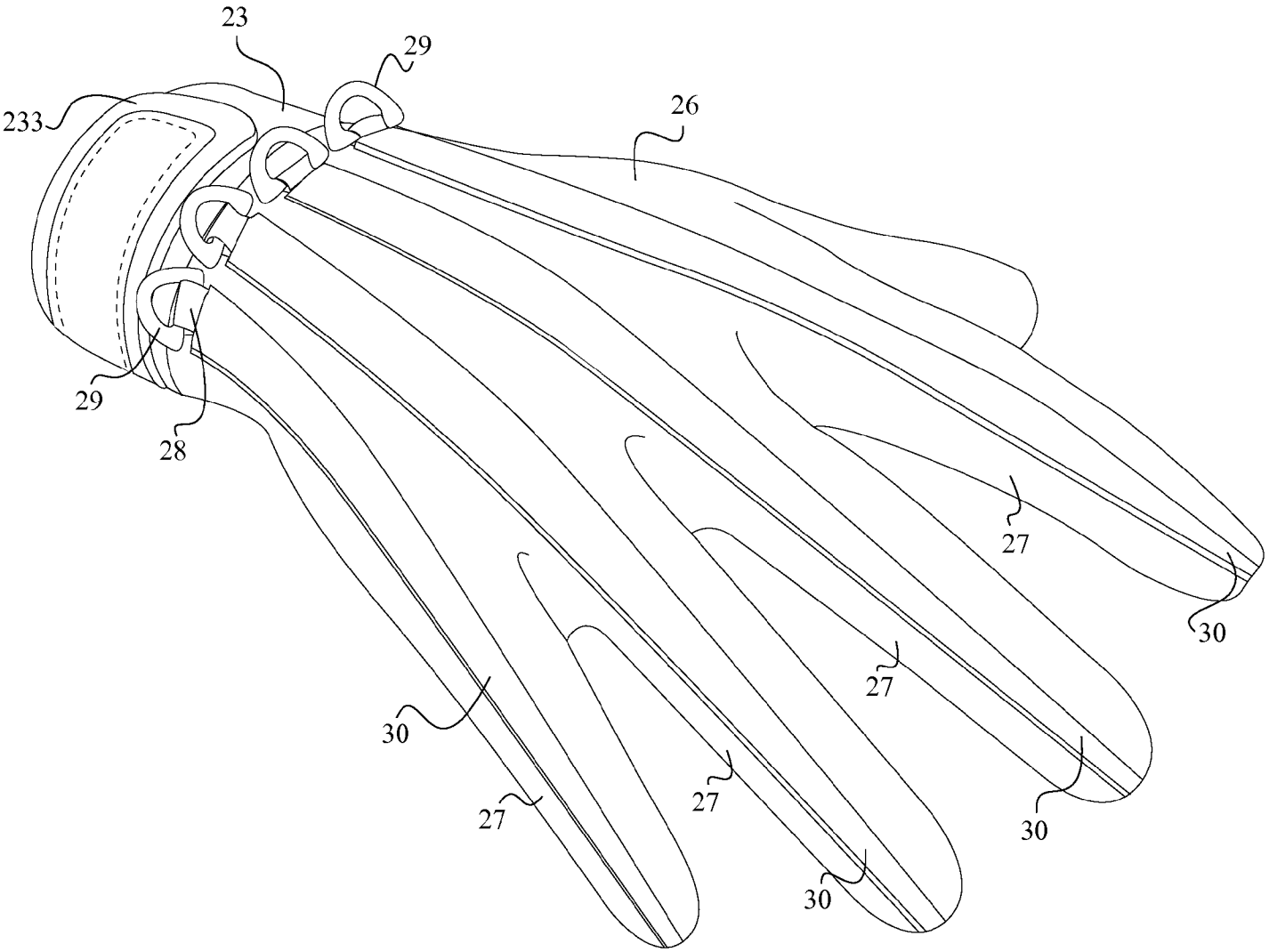
FIG. 7 is a front view in perspective of a fourth embodiment of a glove that can be worn in connection with the present invention
Figure 8:
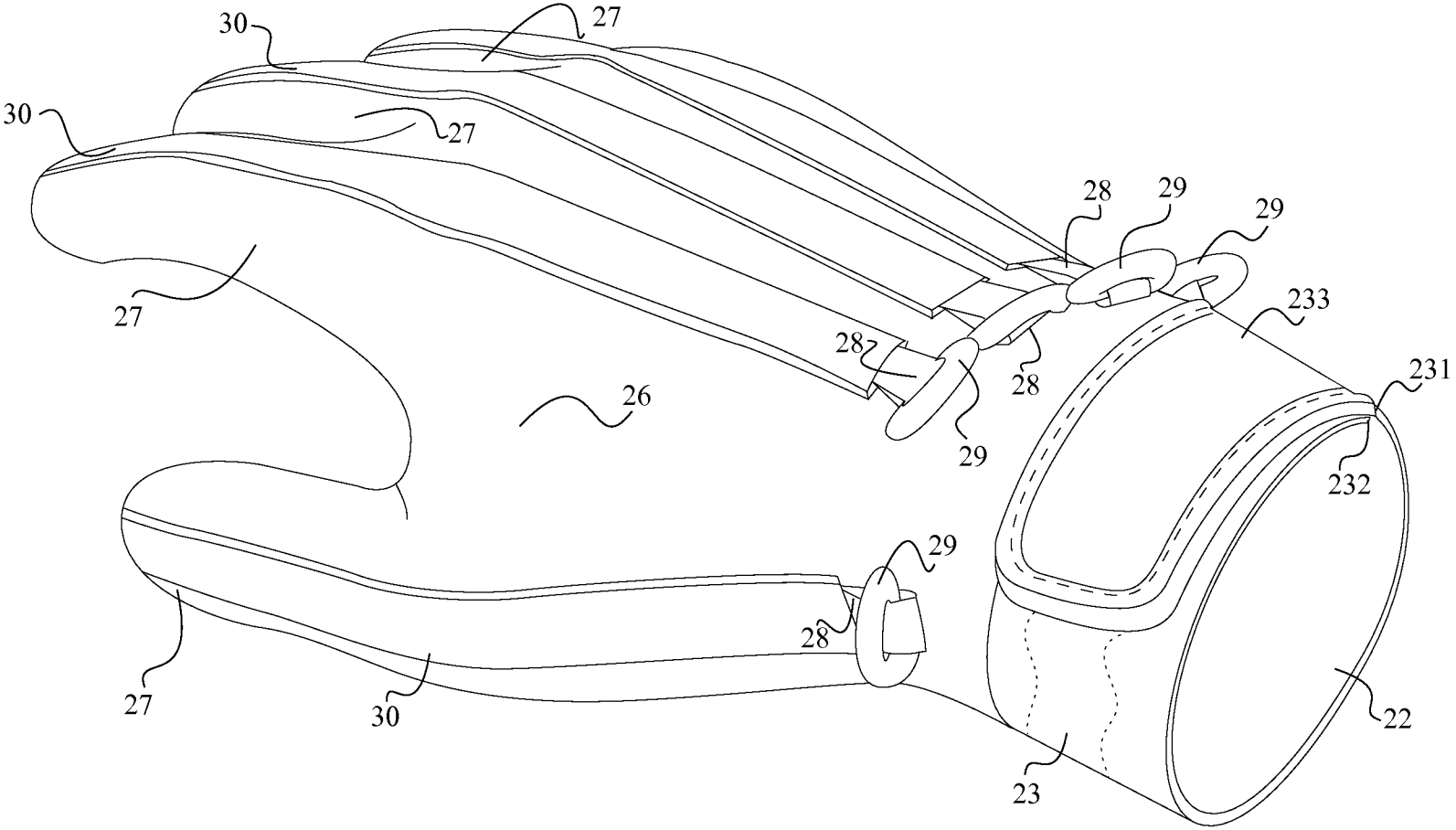
FIG. 8 is a rear view in perspective of the glove in FIG. 8

In reference to FIGS. 7 and 8, left glove 1 and the right glove 2 in the fourth embodiment each comprises the inner glove 26, the plurality of fingertip connectors 28, the plurality of glove D-rings 29, and the fingertip connector cover 30. The inner glove 26 comprises wrist opening 22, the plurality of finger sleeves 27, and wristband 23. The wristband 23 is connected to inner glove 26 from one end, and the plurality of finger sleeves 27 is positioned with inner glove 26 opposite wristband 23. The inner glove 26 is made out of high strength stretchable fabric, and comprises the shape of a human hand. The wrist opening 22 is positioned within the wristband 23. When a user inserts a hand through wrist opening 22 into inner glove 26, the user's fingers traverse into the plurality of finger sleeves 27. The wristband 23 allows the user to adjust the comfort fit of the glove. The wristband 23 comprises the first end 231, the second end 232, adjustable wrist strap 233, glove loop fastener material 234, and glove hook fastener material 235. The adjustable wrist strap 233 is connected to wristband 23 from first end 231 and positioned on the outside surface of the wristband 23. The glove hook fastener material 235 is connected to the second end 232 from the outside surface of the wristband 23. The glove loop fastener material 234 is positioned between adjustable wrist strap 233 and glove hook fastener material 235, and glove loop fastener material 234 is connected to adjustable wrist strap 233. Since the first end 231 and second end 232 are attached together by the glove hook fastener material 235 and the glove loop fastener material 234, the user can adjust the circumference of the wristband 23 by means of adjustable wrist strap 233. The plurality of fingertip connectors 28 is firmly connected with the plurality of finger sleeves 27 around the finger nails, but extends toward the wrist of the user, and the plurality of glove D-rings 29 is pivotably connected with the plurality of fingertip connectors 28 from the free end. In the fourth embodiment, the plurality of glove D-rings 29 is positioned adjacent the wrist of the user. The fingertip connector cover 30 is positioned over the plurality of fingertip connectors 28 and connected to the inner glove 26. Since fingertip connector cover 30 is not connected to the plurality of fingertip connectors 28, the plurality of fingertip connectors 28 easily moves inside the connector cover while keeping the plurality of fingertip connectors 28 inline.

Figure 11:
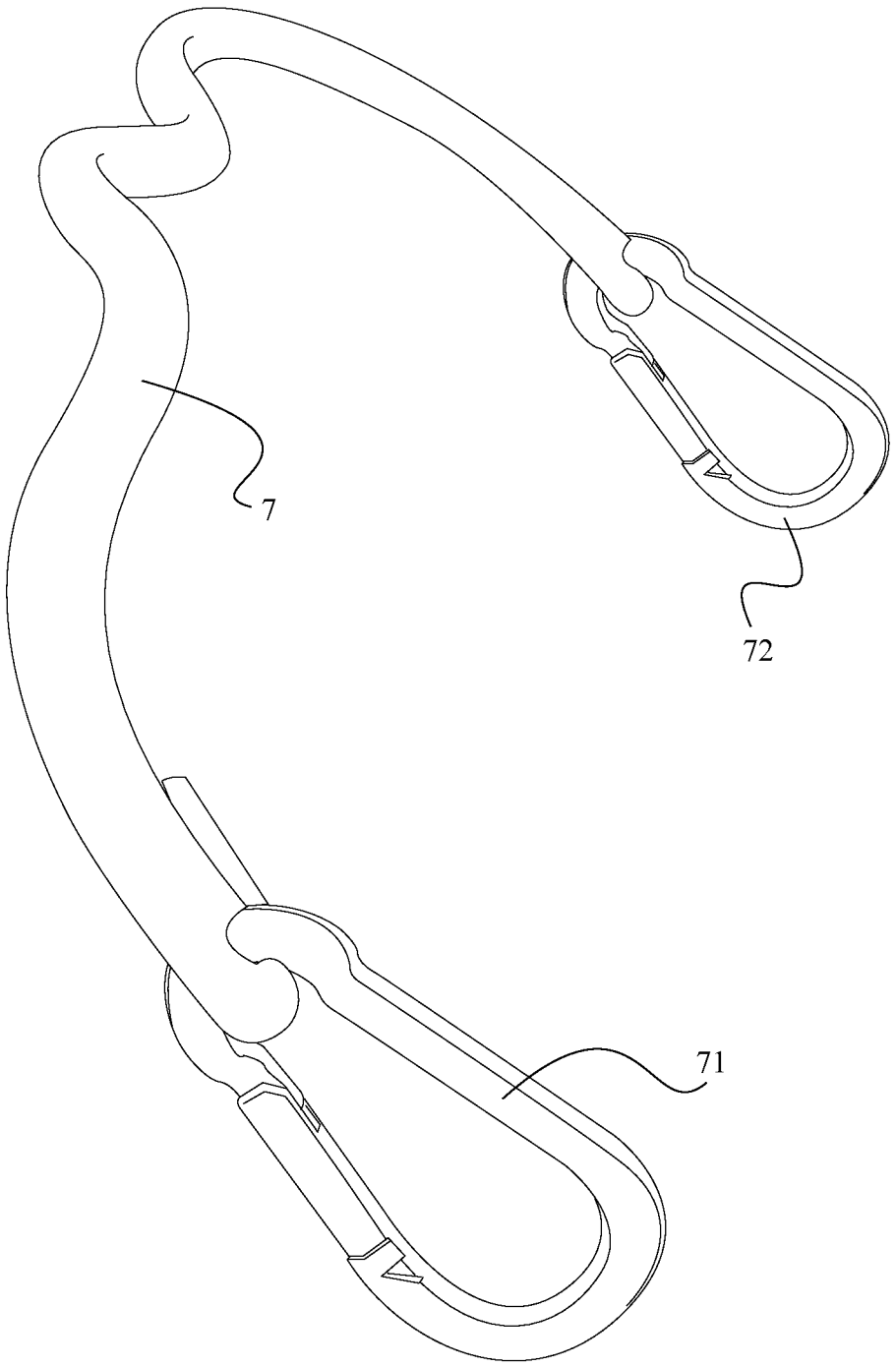
FIG. 11 is a view in perspective of a resistance band employed in the present invention.

Referring to FIG. 11, each of the plurality of resistance bands 7 comprises a first a second attachment clips 71 and 72. The first attachment clip 71 is connected to each of the plurality of resistance bands 7 from one end, and the second attachment clip 72 is connected to the each of the plurality of resistance bands 7 from the opposite end. The connections between the resistance bands 7 and their attachment clips 71, 72 may be a 360° rotatable swivel attachment or fixed attachments. The resistance bands 7 are made from elastically expandable materials such as rubber or a similarly elastic polymer. The band material and configuration are chosen such that the band is able to stretch to approximately three times its quiescent (i.e., unstressed) length. The clips 71, 72 are made from lightweight and high strength metal or plastic materials. Attachment clips 71 and 72 have a movable (e.g., pivotable) rod, preferably biased to a closed position, which can be controlled by the user so that the plurality of resistance bands 7 can be attached to other system components, such as the glove 1, 2, belt 4, vest 3, left shoe 5, and right shoe 6.

In the illustrated embodiment described above, the gloves 1, 2 are attached to the vest 3 by the plurality of resistance bands 7. The first attachment clips 71 are attached to the glove D-ring 24 in the first and second embodiments or to the plurality of glove D-rings 29 in the third and fourth embodiments, and the second attachment clips 72 are attached to the plurality of vest rings 33. Additionally, the second attachment clips 72 can be attached to the plurality of vertical rings 43, the plurality of horizontal rings 44, the plurality of O-rings 64, and shoe D-ring 65. In the illustrated embodiment, shoes 5 and 6 are attached to the belt 4 by the plurality of resistance bands 7. The first attachment clips 71 are attached to the plurality of O-rings 64 and the shoe D-ring 65, and the second attachment clips 72 are respectively attached to the plurality of vertical rings 43 and the plurality of horizontal rings 44. Additionally, the second attachment clips 72 can be attached to the vest rings 33 and the glove D-ring 24 or the glove D-rings 29. Additionally, vest 3 can be attached to belt 4 by the plurality of resistance bands. The first attachment clips 71 are attached to the plurality of vest rings 33, and the second attachment clips 72 are attached to the vertical rings 43 and/or to the horizontal rings 44.

Since the attachment between the gloves 1, 2, belt 4, vest 3, left shoe 5, and right shoe 6 are implemented from the plurality of resistance bands 7, users can perform a variety of exercises while keeping their hands free from the tensioned system components of the present invention. The resistance level between each component attachment may be changed by the plurality of resistance bands 7. The plurality of resistance bands 7 may comprise different resistance level bands such as, soft bands, moderate bands, or hard bands, each providing a different degree of tension. Since more than one resistance band can be attached between the components, users can also attached multiple resistance bands in parallel for additional resistance.

Referring again to FIGS. 9, 11, 14 and 15 and the related description thereof, the attachment clips 71 and 72 of the resistance bands 7 may attach to the plurality of vertical rings 43 and the plurality of horizontal rings 44 on the front of the belt 4, the plurality of O-rings 64 and the shoe D-ring 65 through one of the following manners:

One resistance band 7 can be connected with attachment clip 71 to the plurality of O-rings 64 on the left shoe, and then run up and through the plurality of vertical rings 43 and back down to the right shoe, attaching with the second attachment clip 72 to one of the plurality of O-rings 64.

Alternatively, one resistance band 7 may attach to the plurality of vertical rings 43 with the clips 71 and the other end of the same resistance band 7 may attach to the right shoe using the second attachments 72 on one of the plurality of O-rings 64. Another resistance band 7 of the same length would then attach to the plurality of vertical rings 43 with the first attachment clips 71 and the other end of the same resistance band 7 would attach to the left shoe using the second attachments 72 on one of the plurality of O-rings 64.

As yet another alternative, one resistance band 7 may attach to the horizontal rings 44 on the right side with the first attachment clips 71 and the other end of the same resistance band 7 would attach to the right shoe using the second attachments 72 on one of the plurality of O-rings 64. Another resistance band 7 of the same length would attach to the horizontal rings 44 on the left side with the first attachment clips 71 and the other end of the same resistance band 7 would attach to the left shoe using the second attachments 72 on one of the plurality of O-rings 64.

The resistance bands 7 may attach with the attachment clips 71 and 72 to the plurality of horizontal rings on the back of the belt 4 or to the plurality of vertical rings 48 on the back of the belt, and the shoe D-ring 65 through one of the following manners:

One resistance band 7 may be connected with the first attachment clip 71 to the shoe D-ring 65 on the left shoe, and then running up and through plurality of vertical rings 48 and back down to the right shoe, attaching with the second attachment clip 72 to the shoe D-ring.

Alternatively, one resistance band 7 may attach to the plurality of vertical rings 48 with the first attachment clips 71 and the other end of the same resistance band 7 would attach to the left shoe using the second attachments 72 on the shoe D-ring 65, and another resistance band 7 of the same length would attach to the plurality of vertical rings 48 with the first attachment clips 71 and the other end of the same resistance band 7 would attach to the right shoe using the second attachments 72 on the shoe D-ring 65.

As a further alternative, one resistance band 7 may attach to the horizontal rings on the right-rear side of the belt 4 with the first attachment clips 71 and the other end of the same resistance band 7 attaches to the right shoe using the second attachments 72 on the shoe D-ring 65. Another resistance band 7 of the same length attaches to the horizontal rings on the left-rear side of the belt 4 with the first attachment clips 71 and the other end of the same resistance band 7 attaches to the left shoe using the second attachments 72 on the shoe D-ring 65.

Figure 24:
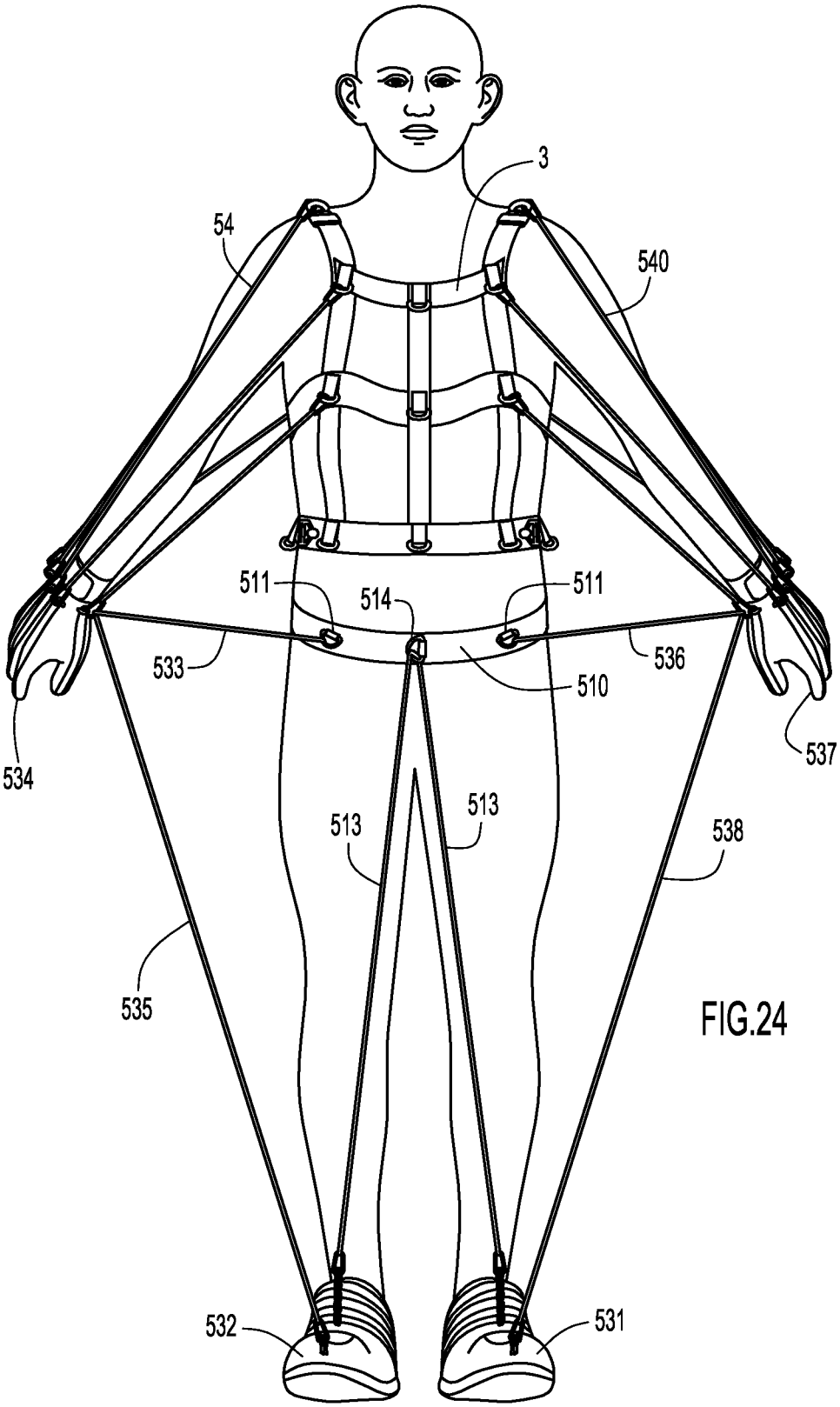
FIG. 24 is a front view of a second embodiment of the system of the present invention being worn by a user.
Figure 25:
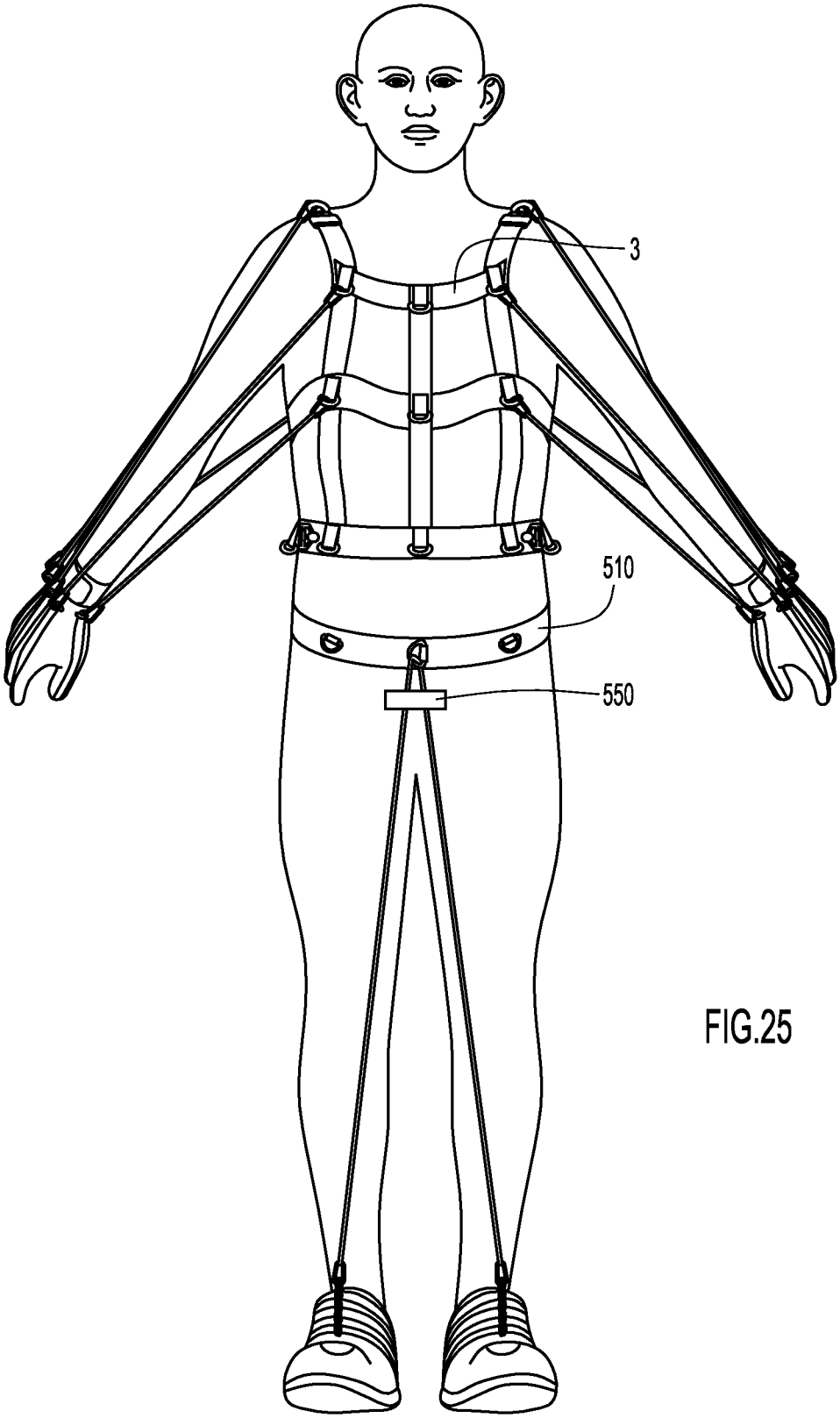
FIG. 25 is a front view of the system of FIG. 24 with the addition of a band stabilizing member.

Examples of multiple band attachments may be seen in FIGS. 24 and 25 of the accompanying drawings.

The inverted "V" shape created by the single front and back band configuration described above provides two unique advantages:

1. The single band inverted "V" configuration meets approximately at the navel position on the front and in the center of the lower back on the back, and attaches in the middle of the upper foot on the front and the middle of the rear of the shoe on the back. The shape of the band in this configuration closely mimics the lower-body's natural physiology. Therefore, when this system is being used, the user's natural body movements are not inhibited by the bands.

2. Because the top of the inverted "V" configuration on the front is located approximately at the navel and then the resistance bands extend down to approximately the center of the foot, the resistance bands remain inwardly disposed along the user's legs and knees during use. This is an important element of the system because it allows the user's legs to move freely in any direction, even at top speed, without the bands inhibiting movement by contacting the knee or crossing over to the outside of the knee. Without this unique feature, natural and full speed movement would be disrupted.

As noted, the resistance bands 7, for use in both front and back in the system, may be provided in at least three different lengths at each resistance tension, depending on the user's height. Having three lengths of bands at each tension level accommodates short, medium and tall users of the device. In this regard, it is important that users have different lengths to choose from. If there were only one length, which for example, was made for a person of average height, then the system would work optimally for an average height person, but not for a short or tall person. For a short person there would be too much slack in the bands, reducing the amount of resistance throughout the full range of motion, limiting the effectiveness of the system. The additional slack could also prove troublesome if the extra slack caused the bands to interfere with the natural motion of the legs. For a tall person, there would be too much tension in the bands in a stationary position, as well as throughout the full range of motion. This situation could cause excessive resistance, especially at full extension, limiting the user's full range of motion and adversely affecting proper technique. Since the bands should not be stretched more than three times their original length without the risk of breaking, a single band length increases the risk of band breakage in taller people. When sold to consumers the product may be provided with a single band of a respective specified length for short, tall or average size persons; alternatively, it may be sold in a kit with different lengths bands.

In addition to multiple band lengths for people of different heights, there may also be different band lengths for the front and rear sides side of the system, as indicated in the following table.

TABLE 1

| HEIGHT RANGE OF USER | FRONT BAND LENGTH (+/− 15%) | REAR BAND LENGTH (+/− 15 %) |
|---|---|---|
| 5' to 5.5' | 20 inches | 26 inches |
| 5.5' to 6' | 24 inches | 30 inches |
| 6' to 6.5' | 38 inches | 34 inches |
| 6.6' to 7' | 32 inches | 38 inches |

The front and rear bands have different lengths for several reasons, but primarily the because during running strides or other leg extension exercises the maximum distance between the rear belt ring and the rear shoe connection ring is greater that the distance between the front belt connection ring and the front shoe connection rings. Thus, the rear bands should be slightly longer than the front bands. The bands are provided in a set of front and rear bands for the end user based on his/her height.

Figure 20:
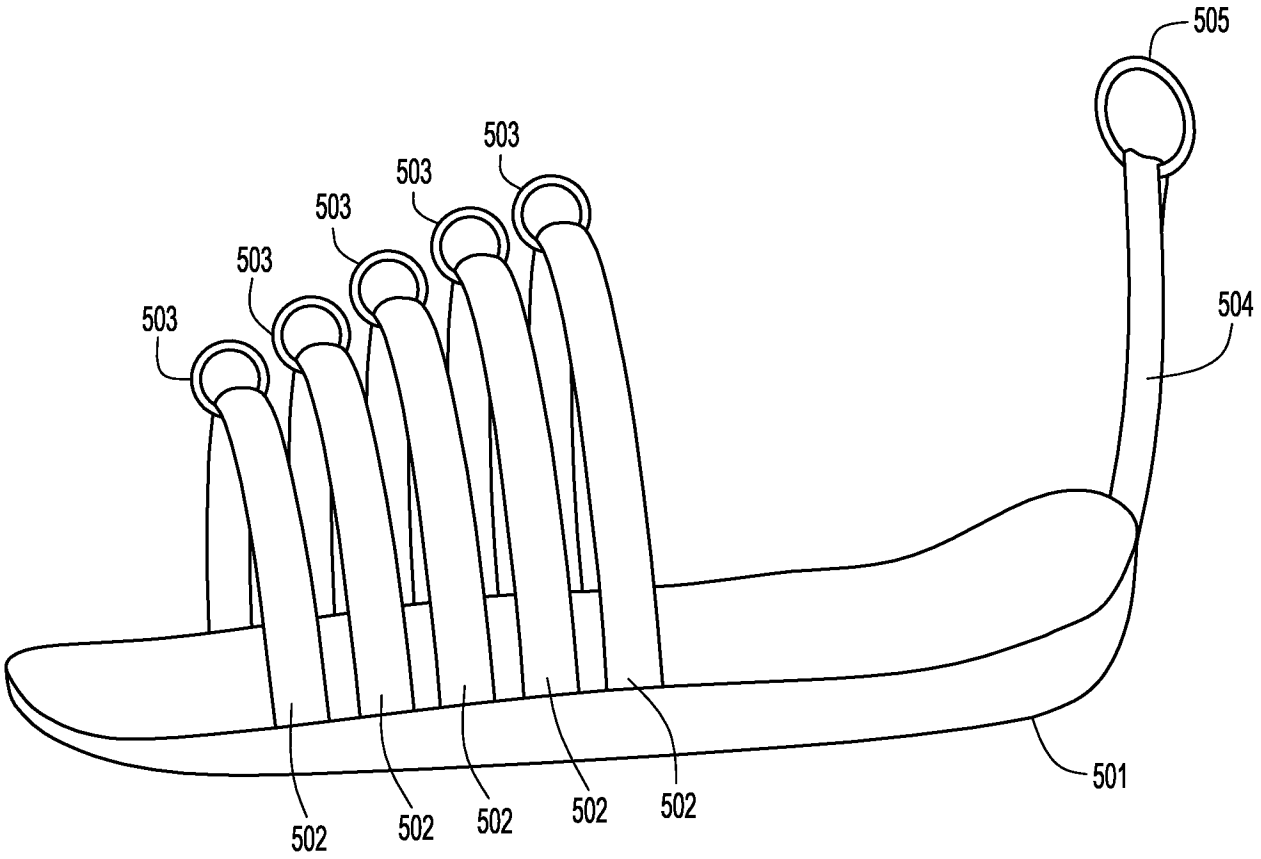
FIG. 20 is a view in perspective of a shoe bed insert that can be used in connection with the present invention.
Figure 21:
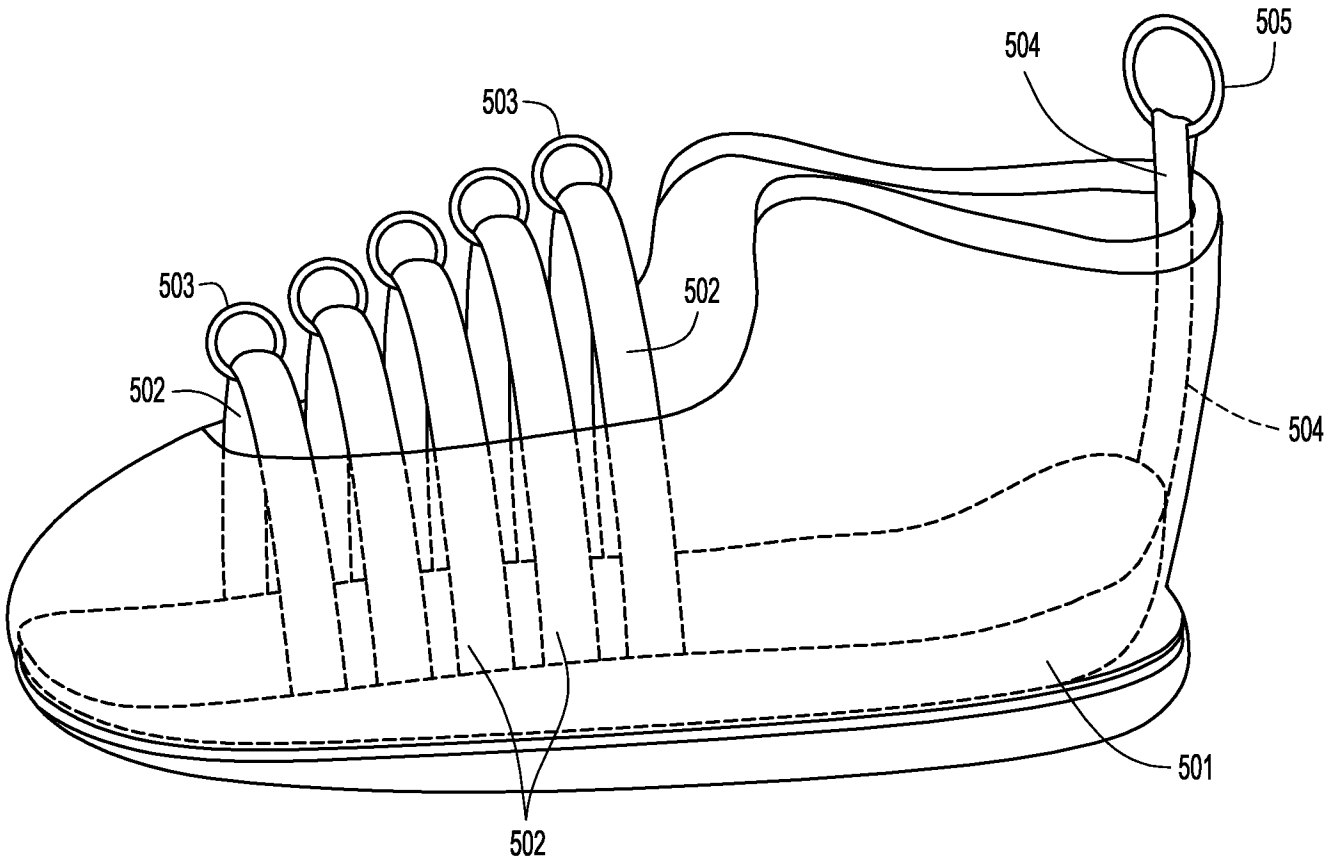
FIG. 21 is a view in section of a shoe with the shoe bed insert of FIG. 20 inserted therein.

Instead of the specially designed shoe illustrated in FIGS. 9 and 10, a foot bed insert of the type illustrated in FIGS. 20 and 21 permits the system of the invention to be utilized with substantially any conventional shoe. Specifically referring to FIGS. 20 and 21, a shoe-bed insert 501 comprises any number of types of removable shoe beds or sole inserts which may be inserted into a shoe either on the existing shoe insole or in place of the insole. The shoe bed insert 501 may be provided in multiple sizes to, respectively, fit all shoe sizes, or in a more limited number of sizes such that the insert can be cut down by the end user to the appropriate desired size. Attached to the shoe bed is one or more transversely extending front straps 502 with attachment points on the side of or beneath the shoe bed unit. As described above in connection with the straps on the shoes, the straps 502 may be continuous loops embedded in the insert 501. Encircling each front strap 502 is a respective ring 503 through which the front straps extend. The rings 503 may be connected to the strap to merely wobble freely from side to side at one location on their respective straps 2, but preferably are free to traverse the straps along substantially the entire width of the user's foot in the same manner described above for rings 64 and straps 63 a shoe. On the heel of the shoe bed insert there is attached a rear strap 504 which extends upward along the center of the back of the insert 501 to approximately the top of the shoe opening into which the foot bed is inserted. Attached to rear strap 504, preferably at the distal end of the strap, is a rear ring 505. In this configuration the shoe bed 502, front straps 502, rings 503, rear strap 504 and rear ring 505 are inserted into the shoe with the tongue of the shoe positioned above the shoe bed and below the front straps, allowing the shoe bed insert to rest appropriately inside the shoe. The front straps 502 and rings 503 are located between the shoelaces and extend above the shoe and rear strap 504, whereby ring 505 protrudes out from the top of the back of the shoe.

The foot bed insert with straps and rings allows the user to take advantage of the system using his/her own shoes as opposed to the specially configured shoe of FIG. 9. The strap and ring configurations remain similar to those on the shoes and provide the same benefits. Those benefits include, but are not limited to:

Engagement of the foot in the system—By attaching the resistance bands to the foot, the foot joints and muscles, crucial components of any sport-specific movements, speed and agility, are incorporated into the resistance workout.

By having an attachment point over the longitudinal center line of the foot, as opposed to on the interior or exterior of the foot, the insert keeps the resistance bands/straps from unnaturally pulling the foot to the inside or outside, respectively. Instead, the center attachment point allows resistance to be provided in an anatomically correct manner, allowing the user to maintain proper technique during workouts.

By allowing the rings to move freely from side to side over the straps, the user may move freely and naturally without disproportionate resistance being applied to the foot. The freely moving rings allow uniform and directionally natural resistance to be applied to the foot throughout a full range of movement, maximizing the effectiveness of sport-specific neuromuscular conditioning.

Figure 23A:
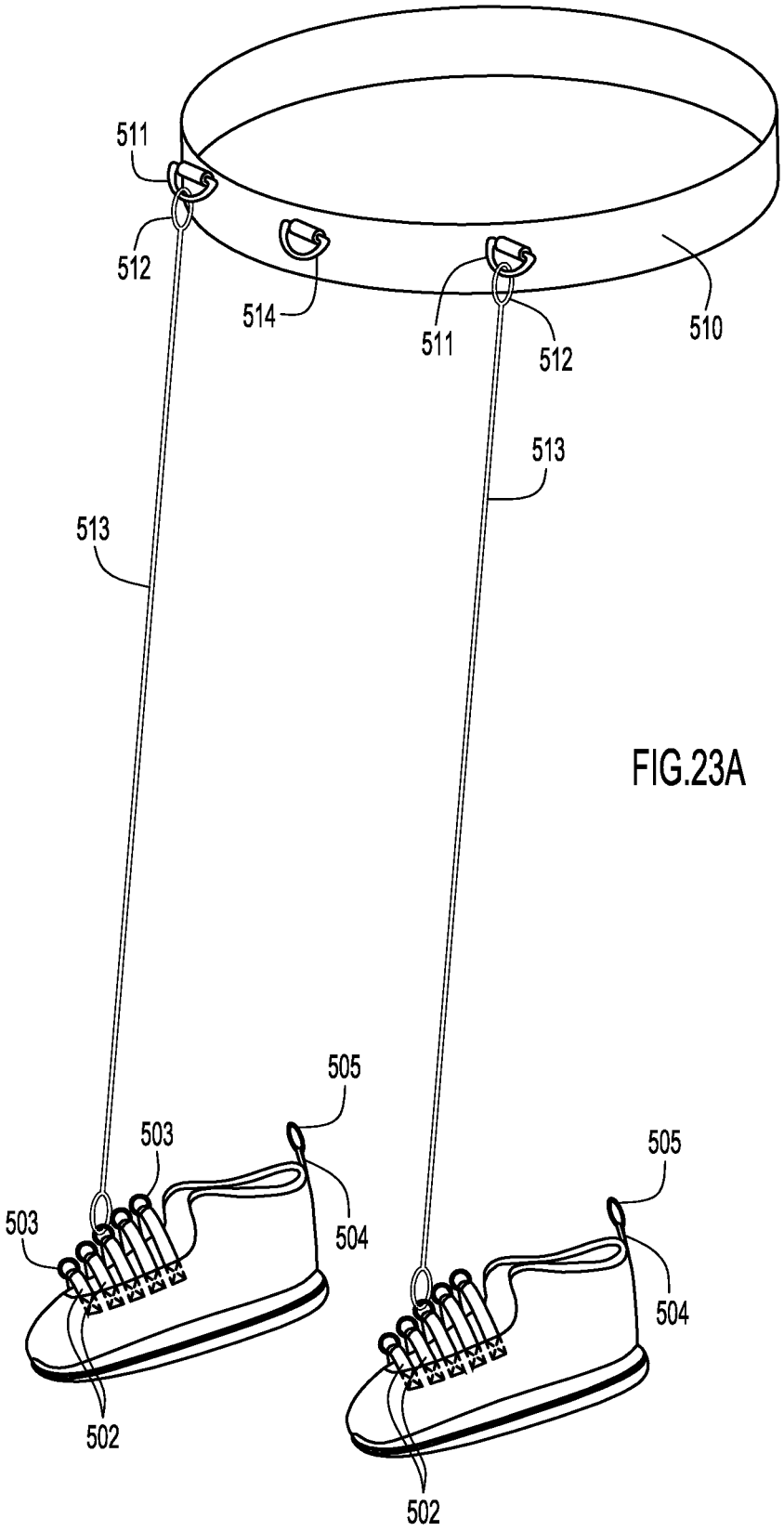
FIG. 23A is a front view in perspective of a second embodiment of a belt that can be worn in connection with the present invention showing a first attachment arrangement of resistance bands to a shoe or shoe bed insert.
Figure 23B:
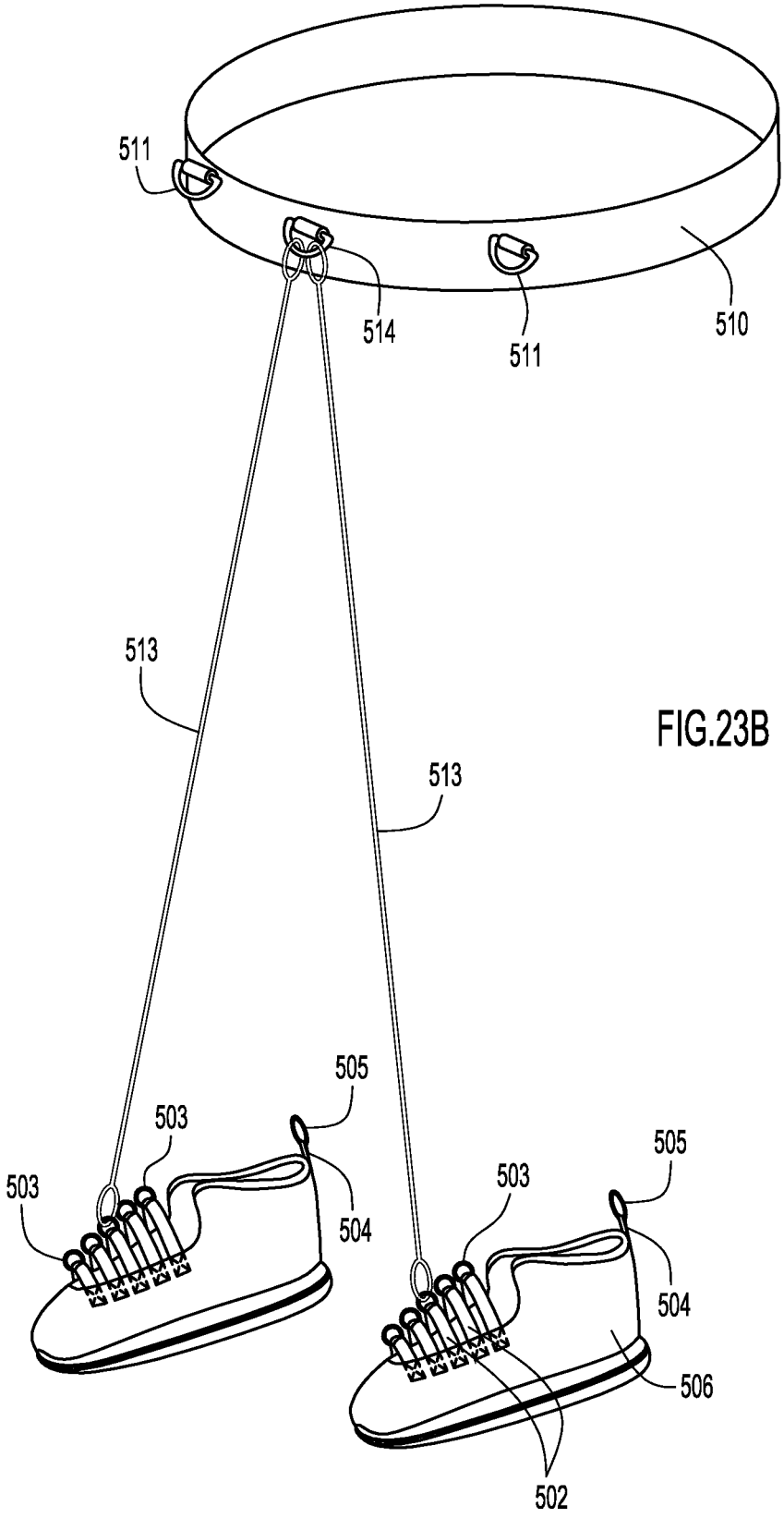
FIG. 23B is a front view in perspective of a second embodiment of a belt that can be worn in connection with the present invention showing a second attachment arrangement of resistance bands to a shoe or shoe bed insert.

As shown in FIGS. 23A and 23B, resilient resistance straps can be attached between respective shoes or inserts and the system belt, either at a common ring centered on the belt or at respective rings on each side of center. Referring specifically to FIG. 23A, there is illustrated a belt 510 similar in structure and function to belt 4 described in relation to the system of FIG. 18 and more specifically in relation to FIGS. 13 and 14. Belt 504 has attached thereto a center ring 514 disposed at the front of the belt and two side rings 511 disposed on opposite sides of ring 514. Each of rings 511 and 514 is preferably a D-ring mounted on the belt so as to be feely pivotable about respective horizontal axes (i.e., axes parallel to the belt length). A pair of longitudinally elastic resistance bands 513 is shown in FIG. 23A secured between respective side rings 511 and a selected ring 503 on a respective shoe or foot bed insert 506. The attachment means 512 at the ends of the resistance bands may be any conventional means such as clips 71, 72 described in relation to FIG. 11. Alternatively, and referring to FIG. 23B, the bands 513 may both be attached to the center ring 514. As a further alternative, it is to be understood that the side rings 511 may be positioned very close to or at the center of the belt so that the resistance bands can extend from the belt center but from separated rings.

There are further advantages to the foot bed insert. By attaching the front straps to a foot bed insert positioned underneath the foot (as opposed to an attachment which is not secured to an element underneath the foot), the integration of the foot into the resistance system is maximized, providing for a very efficient workout. By connecting the straps to an element underneath the foot, the foot and leg muscles are subjected to resistance, both when the foot is lifted off the ground and when the foot is placed back down on the ground, in a most efficient manner because constant pressure is being applied beneath the foot.

Referring to FIG. 24, the belt 510 in FIG. 23B is shown incorporated into the system of the invention whereby resistance bands 513 extend between the center ring 514 on the belt to selected rings on either a shoe or a foot bed insert 531, 532, as desired by the user. The side rings 511 are connected by respective resistance bands 533, 536 to respective gloves 534, 537 which may take the form of any of the glove embodiments described and illustrated herein. The belt thusly serves as the anchor for resistance bands connected to each of the hands and feet of the user. This is in addition, of course, to the anchoring function served by vest 539 which, as illustrated in FIG. 24, is connected at various levels of the vest to the gloves 534, 537 via several additional resistance bands 540, 541, etc.

Figure 22:
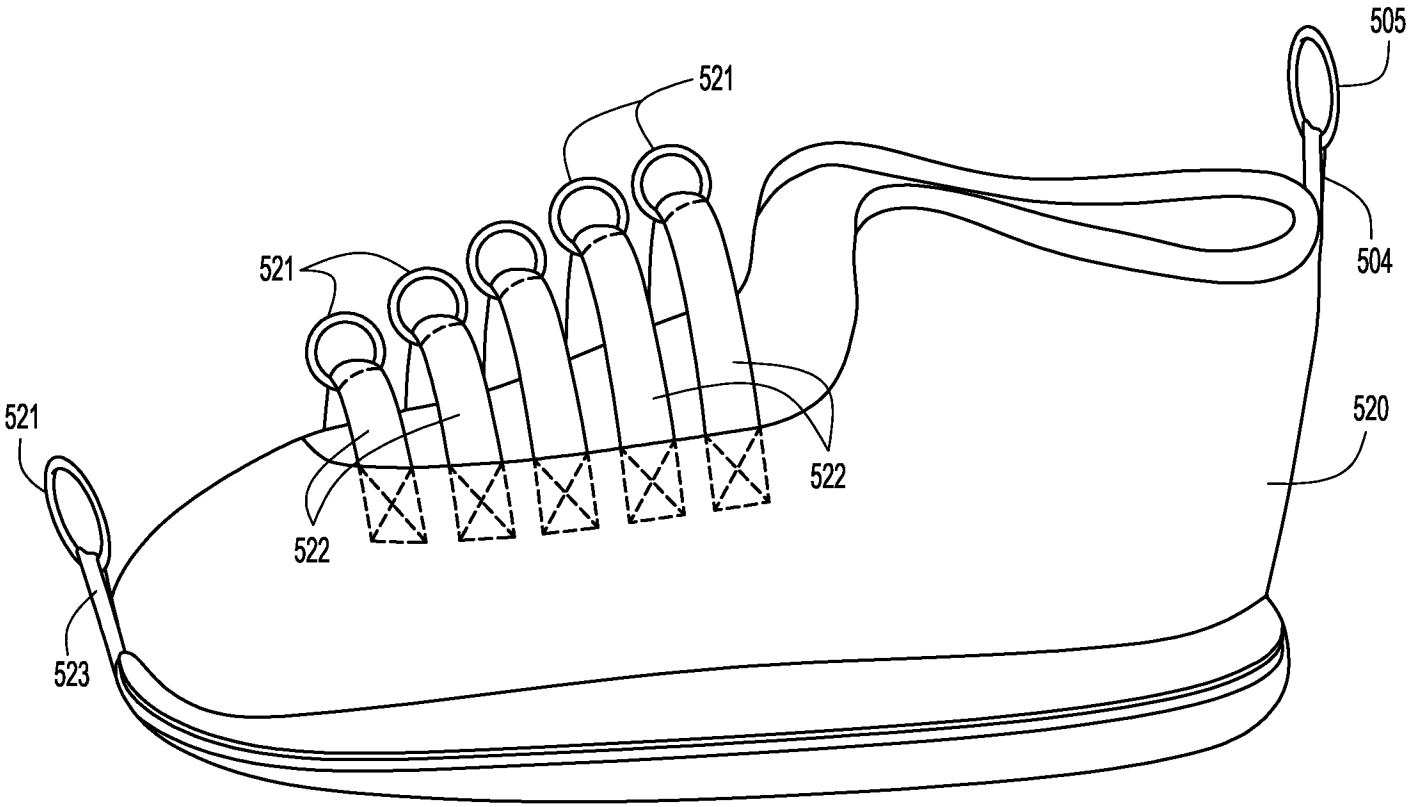
FIG. 22 is a view in perspective of a second embodiment of a shoe that can be worn in connection with the present invention.

In the embodiments described above, the rings on the front straps of the shoes or foot bed inserts may not be affixed to the straps; that is, the rings may slide loosely along the straps. This allows for excellent resistance, assuring that the resistance bands self-adjust positionally with the direction of the tension force applied through the resistance band, and are properly positioned and engaged during the entire exercise session. However, it is also possible to secure the straps to the rings to preclude relative movement therebetween and still provide for advantageous resistance effects. Specifically, and referring to FIG. 22 of the accompanying drawings, the rings 521 can be fixed to any one or more points of each strap 522 by stitching, industrial strength glue, etc. In addition, or alternatively, the front portion of the shoes may have one or more tabs 523 affixed thereto with one or more rings 521 secured to the tabs. This provides for improved force concentration on the front part of the shoe. When an athlete trains with this configuration he/she will have resistance concentrated on the front part of his/her feet. When running at full speed, orientation of the front portion of the foot at ground contact is important, and this embodiment provides a more specific way to train for this type of action. It should be understood that this affixed ring embodiment applies to all types of footwear described herein, including but not limited to shoes with straps, ankle brace with straps, foot bed inserts, and the over the shoe sock with mesh bottom.

Figure 26:
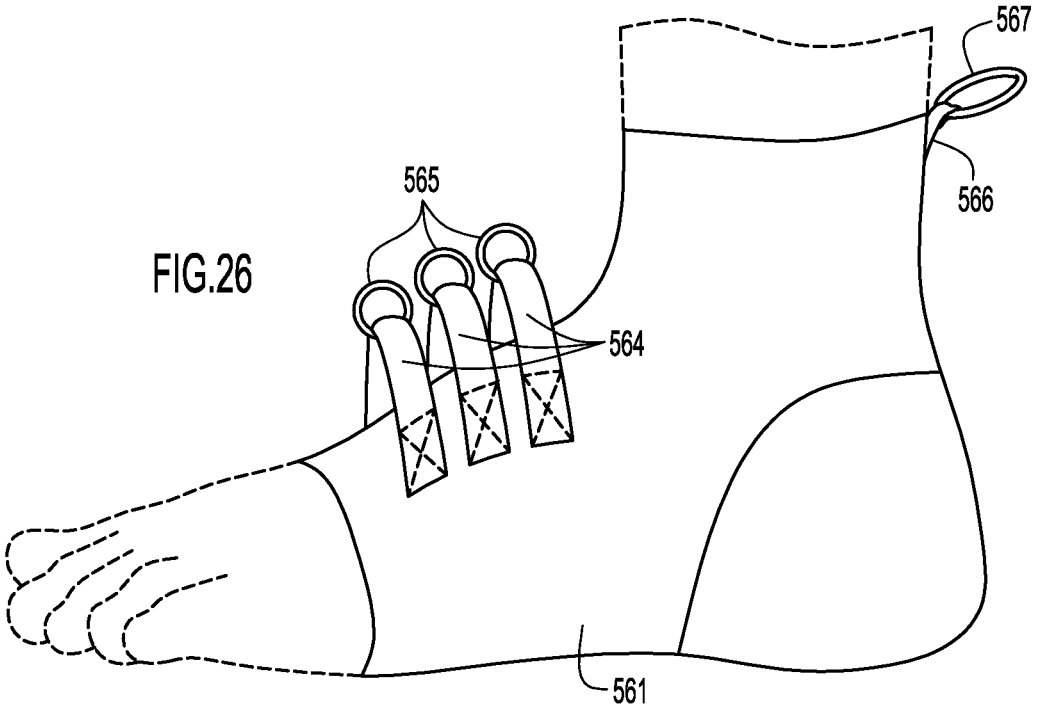
FIG. 26 is a side view in perspective of an ankle brace that can be worn in connection with the present invention.
Figure 27:
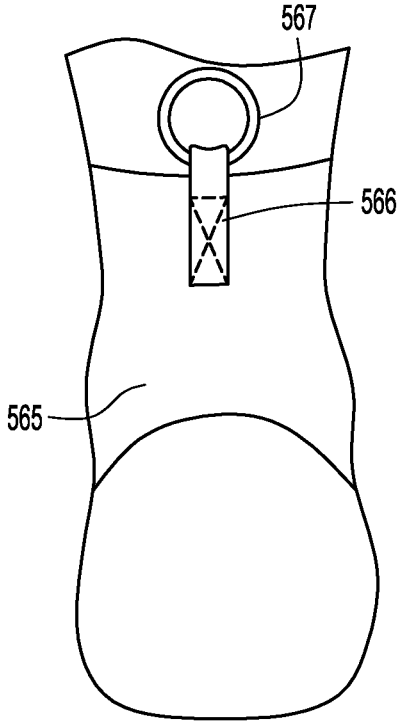
FIG. 27 is rear view of the ankle brace in FIG. 26.

Referring to FIGS. 26 and 27 of the accompanying drawings, an ankle brace/sock unit 561 has front and rear openings and comprises: front straps 564, rings 565, rear strap 566 and a top opening of ankle brace/sock 567. The ankle brace or sock 1 can be made from any type of removable material which would be placed over the ankle. This ankle brace or sock 561 has a top opening as well as the front and rear openings. This allows for easy placement of the unit over the user's ankle such that the ankle and the rest of the leg protrude from the top opening of the unit, the user's heel protrudes from the rear opening, and the ball of user's foot protrude from the front opening. Attached to the unit 561 are one or more front straps 564 with attachment points on the side of or beneath the unit. Attached to each front strap are one or more rings 565 through which the front straps extend such that the rings can move freely from side to side along the straps. On the heel side of the unit is attached a rear strap 566 which extends up along the center of the back of the unit to approximately the top of the unit. Attached to the rear strap 566 are one or more rings 567. In the configuration described above, the unit 561 is placed around the ankle and the user then puts on his/her own shoe. The front straps 564 and rings 565 then reside between the shoe's laces and extend above the shoe, and the rear strap 566 and ring 567 protrude out from the top of the back of the shoe.

The ankle brace insert with straps and rings allows the user to take advantage of the system using his/her own shoes as opposed to shoes specially constructed for use with the system. The strap and ring configurations remain similar to those on the shoes described above and provide the same benefits which include, but are not limited to:

Engagement of the foot in the system—By attaching the resistance bands to the foot, the foot joints and muscles, crucial components of any sport-specific movements, speed and agility, are incorporated into the resistance workout.

By having an attachment point over the center of the foot, as opposed to on the interior or exterior of the foot, keeps the resistance from unnaturally pulling the foot to the inside or outside, respectfully. Instead, the center attachment point allows resistance to be provided in an anatomically correct manner, allowing the user to maintain proper technique during workouts.

By allowing the rings to move freely from side to side over the straps, the user may move freely and naturally without disproportionate resistance being applied to the foot. The freely moving rings allow uniform and directionally natural resistance to be applied to the foot throughout a full range of movement, maximizing the effectiveness of sport-specific neuromuscular conditioning.

An over the-shoe sock 571 with mesh bottom is illustrated in FIGS. 28 and 29 to which reference is now made. The sock has a mesh bottom 572, one or more front straps 573, one rear strap 578, one or more front secure straps 575, a rear secure strap 576, one or more securing mechanisms such as Velcro, buckles, buttons, etc., one or more rings 574, and a rear ring 577. This unit is designed to be worn and fit over any cleated shoe such as used for football, soccer, lacrosse, etc. Unit 571 is constructed in a way that the mesh bottom 572 has interstices at spaced locations that allow the cleats to protrude through. The entire system is secured by one or more securing mechanisms such as Velcro, buckles, buttons, etc., which can be at the front and/or the rear of the unit. The unit also has one or more front straps 575 and one rear strap 578. Each of the front straps is encircled by a respective ring 574; the rear strap is encircled by ring 577. The front rings 574 are not affixed to their respective rings and are, therefore, free to slide from side to side. This allows the user to have the resistance move in a lateral fashion with him/her during workouts. Rings 574, 577 can be configured in any shape to provide the best connection configuration for the entire system. In this regard, all of the connection rings used in the system may be constructed in any shape suitable for their described function; these include but are not limited to; O-rings, D-rings, regular or irregular polygonal rings, etc. Alternatively, some or all of the rings may be replaced by manually actuable clips.

The advantages of the over the-shoe sock with mesh bottom include allowing the user to take advantage of the system using his/her own cleated shoes as opposed to the having a special cleated shoe designed for the system. The mesh bottom allows the user's cleats to protrude through the unit 571. The strap and ring configurations remain similar to those on the shoes disclosed in application above.

The system includes the capability for attaching each and every component in the system (i.e., the gloves, hand straps, shoes, over-the shoe-sock with mesh bottom, foot bed insert, ankle brace, etc.) to any connection point on any of the components of the system, as the user sees fit. The connections are by means of the resistance bands, and each connection can be effected by one or more resistance bands. If a user wants to connect the gloves with the belt via resistance bands, and bypass the vest, the user can do so. Thus, one of the unique advantages of the system is that it is customizable. If the user wants to connect the gloves to the shoes via resistance bands, the user can do so; if the user wants to connect only one glove with one shoe, the user can do so. If the user wants to connect just one shoe, over-the-shoe with mesh bottom, ankle brace with straps, or foot bed insert with straps to just the belt, perhaps in a rehabilitation setting, the user can do so.

The system as described and illustrated may be used with both vest and its attachments to the limbs and extremities of the user, or with the vest and its attachments alone, or with the belt and its attachments alone. How the system is used will depend on the exercise regimen desired by the user.

With regard to the fasteners that are used in the system, when the band and or bands form a V shape in the center connection point on the belt, it is important to ensure that the bands supply equal resistance to each foot. Plastic fasteners or other means, including direct attachment of the ring to the belt, may be used in this way. When the user places the resistance band and or bands through the center connection point on the belt, the user will measure each end of the band so that one end is not extended further than the other end of the band and or bands as they lay centered on the middle connection point of the belt during set up. At this point the bands are not engaged or connected to the lower connection points in the shoe or ankle brace, etc. It is important to make sure the band and or bands are equal when suspended vertically from the center belt connection point. The bands are secured so that once they become engaged and connected to any of the lower connection point options, they will not shift unevenly; thus, during the entire time of usage each foot will experience equal resistance. These fasteners can be used for the front or rear bands on the belt and can be made of plastic, metal, any sort of fabric, etc.

Referring to FIG. 10 of the accompanying drawings, the shoes, shoe inserts, and ankle brace can be provided with the capability of having affixed resistance bands permanently attached to them, and the belt may be constructed to accommodate this permanent attachment. Likewise, the vest may have one or more connection points placed in the best and most suitable positions for optimal performance.

It is to be understood that particular ring configurations (e.g., O-rings, D-rings, triangle rings, etc., are described and illustrated herein to accomplish various functions pertaining to engagement of straps and bands. It is to be understood that such configurations are not to be construed on limiting the scope of the invention in the sense that any type of ring, as well as any type of ring attachment means, that performs the stated function may be utilized within the scope of the invention. Regarding ring attachment means, it is contemplated that in certain instances rings may be attached directly to a shoe or belt or pad without the need for a strap or other structure described and illustrated herein, and such direction is to be construed as residing within the scope of the invention as claimed.

Having described several embodiments of new and improved sports performance enhancement system, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

Thus, it is also to be understood that the present invention covers the modifications and variations of this invention provided they come within the scope of the appended claims and their equivalents. For example, it is to be understood that terms such as "left", "right" "top", "bottom", "front", "rear", "side", "height", "length", "width", "upper", "lower", "interior", "exterior", "inner", "outer", "horizontal", "vertical", and the like as may be used herein, merely describe points of reference for various orientations of elements and do not limit the present invention to any particular orientation or configuration.

What is claimed is:

1. An article of footwear for use in a resistance exercise system for sports enhancement of the type in which one or more elastic resistance bands are attached between a user's torso and one or more limbs or extremities, said article of footwear adapted to be worn by the user and comprising:

a body member having a forward portion, a rearward portion, and left and right edges;

a first strap extending over said forward portion between two first strap attachment locations at said left and right edges, respectively, said strap having slack so as to be loosely spaced above said forward portion; and a first connection ring member disposed about and freely movable along said first strap, said ring and strap being configured and constructed to be connected at said ring to an elastic resistance band and such that, when the ring is pulled by a force applied thereto through an elastic resistance band, the ring is free to both traverse the strap and pull it in the direction of the force, wherein said slack is sufficient to permit the ring to be so pulled transversely outwardly of the body member beyond said first and second edges.

2. The article of footwear of claim 1 wherein said body member is a foot bed insert.

3. The article of footwear of claim 1 wherein said body member is a shoe body further including:

an outsole;

a shoe upper attached to the outsole; and wherein said two first strap locations are on opposite sides of said shoe upper.

4. The article of footwear of claim 1 further comprising:

a second strap extending over said forward portion between two second strap attachment locations at said left and right edges, respectively, and spaced rearwardly from said first strap along said body member, said second strap having slack so as to be loosely spaced above said forward portion;

a second connection ring member disposed about and freely movable along said second strap, said second ring and strap being configured and constructed to be connected at said second ring to said elastic resistance band, alternatively to said first ring, and such that, when the second ring is pulled by a force applied thereto through the elastic resistance band, the second ring is free to both traverse the second strap and pull it in the direction of the force, wherein said slack is sufficient to permit the second ring to be so pulled transversely outwardly of the body member beyond said first and second edges.

5. The article of footwear of claim 1 further comprising a rear connection ring member secured to said body member at a proximal end of said rear section and configured and constructed to be connected to another elastic resistance band.

6. The article of footwear of claim 1 wherein said body member is an ankle brace having a foot portion and an ankle portion, and wherein said strap is secured to the foot portion to overlie an instep section thereof.

7. The article of footwear of claim 1 wherein said body member is a is an over the shoe sock-like member having a mesh bottom, the sock-like member having a foot portion and an ankle portion, wherein said strap is secured to the foot portion to overlie an instep section thereof, and wherein said mesh portion has interstices to permit cleats of a shoe to extend therethrough.

8. The article of footwear of claim 1 wherein said body member is a shoe body further including:

an outsole;

a shoe upper attached to the outsole;

wherein said two first strap locations are on opposite sides of said shoe upper;

a second strap extending over said forward portion between two second strap attachment locations at said left and right edges, respectively, and spaced rearwardly from said first strap along said body member, said second strap having slack so as to be loosely spaced above said forward portion; and a second connection ring member disposed about and freely movable along said second strap, said second ring and strap being configured and constructed to be connected at said second ring to said elastic resistance band, alternatively to said first ring, and such that, when the second ring is pulled by a force applied thereto through the elastic resistance band, the second ring is free to both traverse the second strap and pull it in the direction of the force, wherein said slack is sufficient to permit the second ring to be so pulled transversely outwardly of the body member beyond said first and second edges.

9. The article of footwear of claim 8 further comprising a rear connection ring member secured to said body member at a proximal end of said rear section and configured and constructed to be connected to another elastic resistance band.

10. The article of footwear of claim 9 wherein said two first strap locations are on opposite sides of said shoe upper adjacent said junction.

11. The article of footwear of claim 9 wherein said two first strap locations are on opposite sides of said shoe upper spaced from and above said junction.

12. The article of footwear of claim 8 wherein said two first strap locations are on opposite sides of said shoe upper adjacent said junction.

13. The article of footwear of claim 8 wherein said two first strap locations are on opposite sides of said shoe upper spaced from and above said junction.

14. An article of footwear for use in a resistance exercise system for sports enhancement of the type in which one or more elastic resistance bands are attached between a user's torso and one or more limbs or extremities, said article of footwear adapted to be worn on the foot of the user and comprising:

a sock having a top portion with a center section, said sock member adapted and configured when worn by the user for the center section to overlie at least a portion of a longitudinal center line of the user's foot;

a first strap extending transversely of the sock and over said center section between two first strap attachment locations on respective opposite sides of said center section such that said first strap has sufficient slack so as to be loosely spaced above said center section; and a first connection ring disposed about said first strap, said ring and strap being configured and constructed to be connected at said ring to an elastic resistance band and such that, when the ring is pulled by a force applied thereto through an elastic resistance band, the ring pulls the first strap in the direction of the force.

15. The article of footwear of claim 14 wherein said ring is freely movable along said strap and free to traverse the strap when the ring is pulled by said force.

16. The article of footwear of claim 14 wherein said slack is sufficient to permit the ring to be pulled transversely upwardly and outwardly beyond at least one of said two strap attachment locations.

17. The article of footwear of claim 14 further comprising:

a second strap extending over said center section between two second strap attachment locations on respective opposite sides of said center section, said second strap having slack so as to be loosely spaced above said center section; and a second connection ring member disposed about said second strap, said second ring and second strap being configured and constructed to be connected at said second ring to an elastic resistance band and such that, when the second ring is pulled by a force applied thereto through an elastic resistance band, the second ring pulls the second strap in the direction of band.

18. The article of footwear of claim 14 wherein said sock has a rear opening to permit the user's heel to protrude therethrough.

19. The article of footwear of claim 14 wherein said sock has a front opening to permit the user's toes to protrude therethrough.

20. The article of footwear of claim 14 further comprising a rear connection ring member secured to said body member at a proximal end of said rear section and configured and constructed to be connected to another elastic resistance band.

* * * * *